US008256873B2

(12) United States Patent
Yamaguchi et al.

(10) Patent No.: US 8,256,873 B2
(45) Date of Patent: Sep. 4, 2012

(54) LIQUID DISCHARGE APPARATUS

(75) Inventors: Shunji Yamaguchi, Kanagawa (JP); Shigeyoshi Hirashima, Kanagawa (JP)

(73) Assignee: Sony Corporation, Tokyo (JP)

( * ) Notice: Subject to any disclaimer, the term of this patent is extended or adjusted under 35 U.S.C. 154(b) by 267 days.

(21) Appl. No.: 12/693,738

(22) Filed: Jan. 26, 2010

(65) Prior Publication Data

US 2010/0201738 A1 Aug. 12, 2010

(51) Int. Cl.
*B41J 2/165* (2006.01)

(52) U.S. Cl. ..... 347/33

(58) Field of Classification Search ..... 347/33
See application file for complete search history.

(56) References Cited

U.S. PATENT DOCUMENTS

2005/0007412 A1* 1/2005 Nishikawa et al. ..... 347/33
2005/0062797 A1* 3/2005 Kachi ..... 347/33
2007/0046724 A1* 3/2007 Jung et al. ..... 347/33

FOREIGN PATENT DOCUMENTS

JP 2004-255788 A 9/2004
JP 2005-104143 A 4/2005

OTHER PUBLICATIONS

U.S. Appl. No. 12/693,819, filed Jan. 26, 2010, Yamaguchi, et al.
U.S. Appl. No. 12/695,578, filed Jan. 28, 2010, Yamaguchi.

* cited by examiner

*Primary Examiner* — Shelby Fidler
(74) *Attorney, Agent, or Firm* — Oblon, Spivak, McClelland, Maier & Neustadt, L.L.P.

(57) ABSTRACT

An apparatus including nozzles that discharge liquid; a liquid discharge head including nozzle arrays where the nozzles are arranged in one direction; a liquid adsorbent that adsorbs liquid attached to a portion of the liquid discharge head where the nozzle arrays are formed; a moving unit that relatively moves the liquid adsorbent in an arrangement direction of the nozzles; support rollers that support the liquid adsorbent so as to allow the liquid adsorbent to rotate; a rotating shaft corresponding to the axis of rotation of the support roller and rotated in a normal or reverse direction using the relative movement of the liquid adsorbent, which is caused by the moving unit, as a source of power, and a reverse rotation preventing unit that transmits the normal rotation of the rotating shaft to the support roller and does not transmit the reverse rotation of the rotating shaft to the support roller.

9 Claims, 15 Drawing Sheets

LIQUID DISCHARGE APPARATUS

BACKGROUND OF THE INVENTION

1. Field of the Invention

The present invention relates to a liquid discharge apparatus that can maintain a high cleaning effect when cleaning a liquid discharge head where nozzle arrays for discharging liquid are formed.

2. Description of the Related Art

A liquid discharge apparatus such as an inkjet printer forms an image on a recording sheet by discharging ink from nozzle arrays that are formed at a liquid discharge head. For this reason, if an image is formed while a liquid discharge surface (a portion where the nozzle arrays are formed) of the liquid discharge head is contaminated or liquid or dirt is attached to the liquid discharge surface, printing quality deteriorates. In particular, if ink, which has a color different from the colors of existing ink (liquid), may flow back from nozzles in the case of an inkjet printer that manages full color, the color of the ink is mixed to the colors of the existing ink (liquid), so that mixed color ink is discharged during printing. As a result, image quality deteriorates.

Accordingly, in the past, various techniques, which clean a liquid discharge surface of a liquid discharge head, have been proposed in order to prevent the deterioration of printing quality. For example, a rubber blade method, which slides a slightly hard rubber blade over the liquid discharge surface while pushing the rubber blade against the liquid discharge surface, removes contaminations, standing ink, thickened or solidified ink, and the like, which are attached to the liquid discharge surface, by wiping them off. As a result, the discharge of ink is restored or discharge performance is stabilized.

However, ink attached to the liquid discharge surface is apt to remain in the rubber blade method, so that a sufficient cleaning effect may not be obtained. In particular, since a line inkjet printer includes a line head where head chips for discharging ink (liquid) are arranged side by side so as to correspond to a printing width, an ink discharge surface (liquid discharge surface) is wide. For this reason, it is difficult to uniformly push the rubber blade against the entire ink discharge surface, so that wiping is not sufficient. Further, among line heads, there is a line head where stepped portions are formed on an ink discharge surface. In the case of this kind of line head, it may not be possible to remove ink that remains at the stepped portions.

FIGS. 15A and 15B are cross-sectional views showing a state where a line head 120 is being cleaned by a rubber blade method in the related art, as seen from the side surface.

As shown in FIG. 15A, a rubber blade method makes a rubber blade 141 come into contact with an ink discharge surface 121 of a line head 120 and moves the rubber blade 141 along the ink discharge surface 121 in an arrangement direction of nozzles like an arrow, thereby wiping off standing ink and the like that are attached to the ink discharge surface 121. Therefore, it is necessary that the rubber blade 141 uniformly comes into contact with the ink discharge surface 121 without a gap.

Meanwhile, if a stepped portion is formed on the ink discharge surface 121 as shown in FIG. 15B, a gap is formed between a corner of the stepped portion and the rubber blade 141 that comes into press contact with the ink discharge surface 121 and is bent. Accordingly, the rubber blade 141 does not come into contact with the corner of the stepped portion. For this reason, it may not be possible to wipe off residual ink attached to the gap or dirt and foreign materials that are pushed to the corner of the stepped portion by the movement of the rubber blade 141.

Accordingly, there is known a wiping roller method that makes not the rubber blade 141 but a cleaning roller (not shown), which is made of a foam material excellent in water adsorbability, come into contact with an ink discharge surface 121 and rotates the cleaning roller by a motor, so as to adsorb residual ink attached to the corner of the stepped portion. According to this method, the porous foam forming the cleaning roller is recessed so as to correspond to the stepped portion, so that a gap may not be formed at the corner of the stepped portion. Further, since a pore (cell) formed in the porous foam generates a capillary force, it may be possible to clean the ink discharge surface while adsorbing standing ink and the like attached to the ink discharge surface 121 by the capillary force.

Further, there is also known a technique where an elastic roller is rotatably disposed around an axis parallel to an arrangement direction of nozzles and an endless cleaning belt is provided on the outer periphery of the roller. In this cleaning belt method, a cleaning belt for cleaning nozzles comes into press contact with the ink discharge surface 121 due to the elastic action of the roller. Furthermore, the roller is rotationally driven by a motor and the cleaning belt positioned at a position facing the nozzles is rotated, so that it may be possible to remove contaminations from the ink discharge surface 121.

In addition, there is known a cleaning cloth method that uses a tape-shaped cleaning cloth. In this method, a cleaning cloth is automatically wound around a reel by a motor while an action surface of a cleaning cloth is pressed against an ink discharge surface 121 by a plane. For this reason, it may be possible to typically wipe off the ink discharge surface 121 with a fresh portion of the cleaning cloth.

These techniques are disclosed in JP-A-11-78034 and JP-A-5-92575.

SUMMARY OF THE INVENTION

However, in each of these techniques, there is provided a special motor to rotate the cleaning roller or the cleaning belt or to wind the cleaning cloth. For this reason, it may not be possible to avoid the increase in the size and cost of the inkjet printer that are caused by the motor.

Thus, it is desirable to reduce the size of an inkjet printer and to improve the economic efficiency of the inkjet printer while maintaining a high cleaning effect.

According to one embodiment of the invention, there is provided a liquid discharge apparatus. The liquid discharge apparatus includes a plurality of nozzles that discharges liquid; a liquid discharge head that includes nozzle arrays where the respective nozzles are arranged in one direction; a liquid adsorbent that adsorbs liquid attached to a portion of the Liquid discharge head where the nozzle arrays are formed; a moving means for relatively moving the liquid adsorbent in an arrangement direction of the nozzles; support rollers that support the liquid adsorbent so as to allow the liquid adsorbent to rotate; a rotating shaft that corresponds to the axis of rotation of the support roller and is rotated in a normal or reverse direction by using the relative movement of the liquid adsorbent, which is caused by the moving means, as a source of power; and a reverse rotation preventing means for transmitting the normal rotation of the rotating shaft to the support roller and not transmitting the reverse rotation of the rotating shaft to the support roller.

According to the embodiment, the liquid discharge apparatus includes the liquid adsorbent that adsorbs liquid attached to a portion of the liquid discharge head where the nozzle arrays are formed, and the moving means for relatively moving the liquid adsorbent in an arrangement direction of the nozzles. Accordingly, the liquid adsorbent is relatively moved by the moving means, so that the liquid adsorbent may adsorb the liquid attached to a portion of the liquid discharge head where the nozzle arrays are formed.

Further, according to the embodiment, the liquid discharge apparatus includes the support rollers that support the liquid adsorbent so as to allow the liquid adsorbent to rotate; the rotating shaft that corresponds to the axis of rotation of the support roller and is rotated in a normal or reverse direction by using the relative movement of the liquid adsorbent, which is caused by the moving means, as a source of power; and the reverse rotation preventing means for transmitting the normal rotation of the rotating shaft to the support roller and not transmitting the reverse rotation of the rotating shaft to the support roller. Accordingly, the liquid adsorbent is relatively moved by the moving means and the rotating shaft is rotated in the normal direction, so that it may be possible to rotate the liquid adsorbent by the support rollers.

According to the embodiment of the invention, the liquid adsorbent is relatively moved by the moving means, so that the liquid adsorbent adsorbs liquid attached to a portion of the liquid discharge head where the nozzle arrays are formed. Further, the relative movement of the liquid adsorbent is used as a source of power that rotates the rotating shaft of the support roller. When the rotating shaft is rotated in the normal direction, the support roller is rotated by the liquid adsorbent. Accordingly, since an adsorbing portion of the liquid adsorbent is changed, it may be possible to maintain a high cleaning effect. In addition, since it is not necessary that a special motor for rotating the liquid adsorbent is provided, it may be possible to reduce the size of the inkjet printer and to improve the economic efficiency of the inkjet printer.

DESCRIPTION OF THE PREFERRED EMBODIMENTS

Embodiments of the invention will be described below with reference to drawings.

Here, a liquid discharge apparatus of an embodiment of the invention is an inkjet printer 10, which discharges ink as liquid, in the following embodiments. Further, the inkjet printer 10 is a line inkjet printer that includes a line head 20 (which serves as a liquid discharge head in the invention) corresponding to a printing width (for example, A4 size). Furthermore, a nozzle array 32*a*, where a plurality of nozzles 32 for discharging ink is arranged in one direction at a predetermined pitch over the length of a printable maximum-size recording sheet (which corresponds to an object to which ink is discharged) in a width direction, is formed at the line head 20. A portion where the nozzle array 32*a* is formed forms an ink discharge surface 21. In addition, the inkjet printer 10 manages color printing, and includes a nozzle array 32*a* for each of ink colors, such as yellow (Y), magenta (M), cyan (C), and black (K).

[Configuration Example of Liquid Discharge Apparatus]

Figure 1:
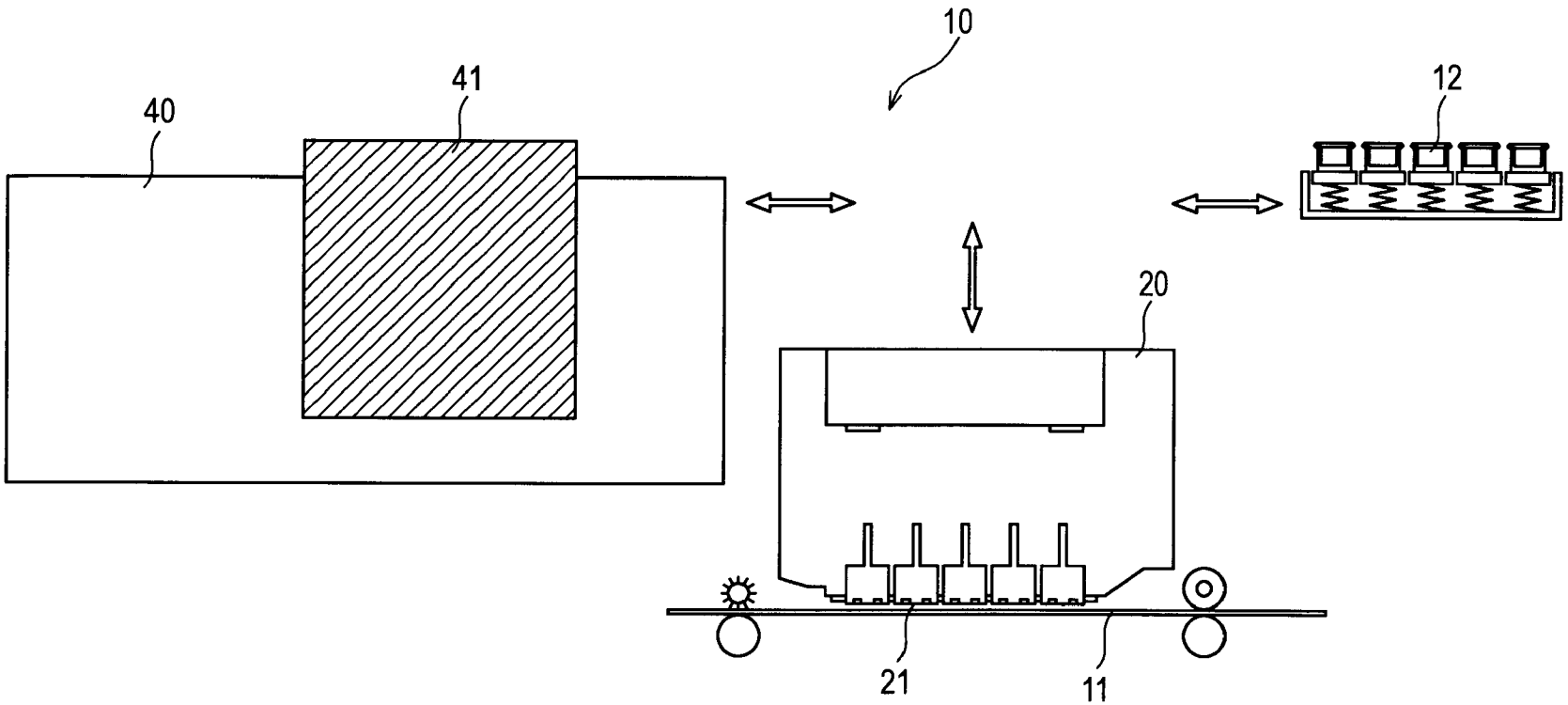
FIG. 1 is a front view showing the entire configuration of an inkjet printer as a liquid discharge apparatus according to an embodiment of the invention, and shows the state of the inkjet printer during printing.

FIG. 1 is a front view showing the entire configuration of an inkjet printer 10 as a liquid discharge apparatus according to an embodiment of the invention, and shows the state of the inkjet printer during printing.

Figure 2:
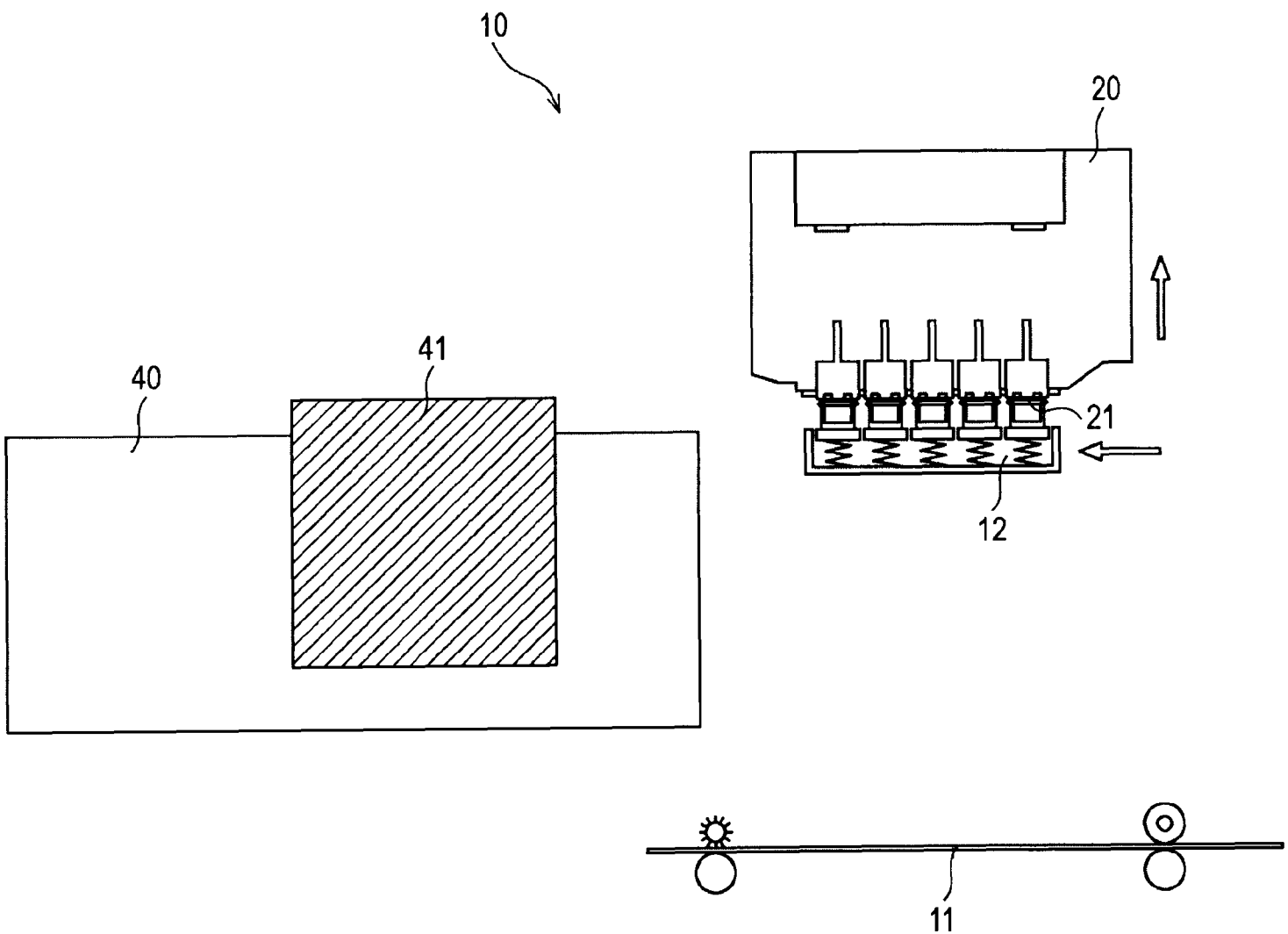
FIG. 2 is a front view showing the entire configuration of the inkjet printer as the liquid discharge apparatus according to the embodiment of the invention, and shows the state of the inkjet printer during standby.

FIG. 2 is a front view showing the entire configuration of the inkjet printer 10 as the liquid discharge apparatus according to the embodiment of the invention, and shows the state of the inkjet printer during standby.

Figure 3:
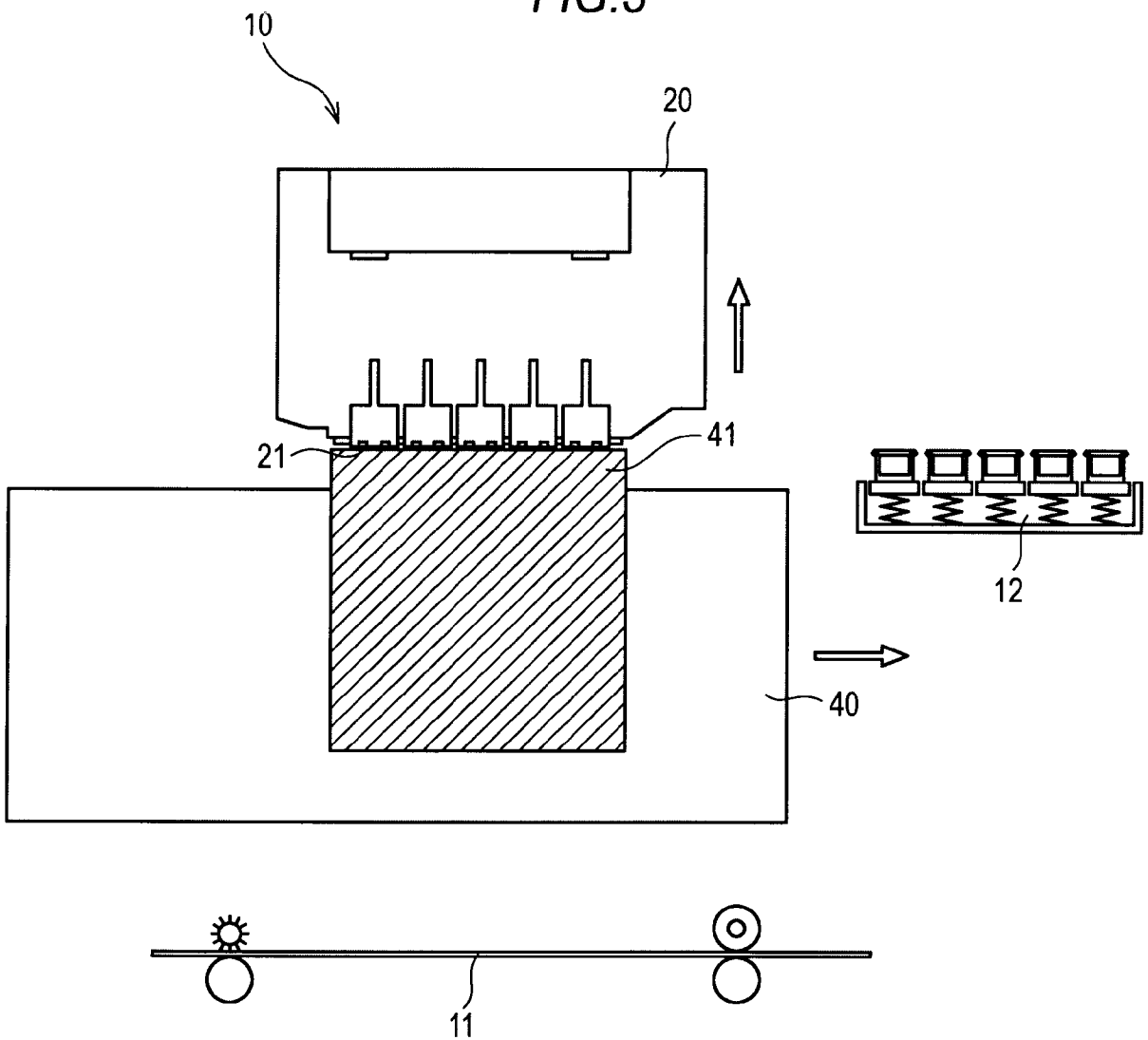
FIG. 3 is a front view showing the entire configuration of the inkjet printer as the liquid discharge apparatus according to the embodiment of the invention, and shows the state of the inkjet printer during cleaning.

FIG. 3 is a front view showing the entire configuration of the inkjet printer 10 as the liquid discharge apparatus according to the embodiment of the invention, and shows the state of the inkjet printer during cleaning.

As shown in FIGS. 1 to 3, the inkjet printer 10 includes a printing table 11 that substantially horizontally supports a recording sheet conveyed from a sheet feed unit (not shown), a line head 20 that forms an image on the recording sheet by discharging ink from an ink discharge surface 21 onto the recording sheet placed on the printing table 11, a head cap 12 that protects the ink discharge surface 21 of the line head 20, and a cleaning device 40 that includes a cleaning belt 41 for cleaning the ink discharge surface 21 of the line head 20.

Further, the inkjet printer 10 includes a lifting unit that lifts and lowers the line head 20 along a vertical arrow (see FIG. 1).

The lifting unit may be formed of, for example, a piston, a cam, a belt, a gear to be rotationally driven, or a combination thereof. Furthermore, the line head 20 is lifted and lowered between a printing position (a position shown in FIG. 1) and a standby position (a position shown in FIG. 2) or a cleaning position (a position shown in FIG. 3) by the lifting unit. At the printing position, the ink discharge surface 21 is lowered directly above the printing table 11 by the lifting unit and an image is formed on the recording sheet. At the standby position, the line head is lifted so that the line head ink discharge surface 21 is covered with the head cap 12. The ink discharge surface 21 may be cleaned at the cleaning position. Meanwhile, the recording sheet is fed onto the printing table 11 from the sheet feed unit (not shown) and is supported substantially horizontally. Further, the recording sheet on which printing has been performed by the line head 20 is discharged to a paper tray (not shown).

In addition, the inkjet printer 10 includes a moving unit that moves the head cap 12 or the cleaning device 40 along a horizontal arrow (see FIG. 1). The moving unit may be formed of, for example, a piston, a cam, a belt, a gear to be rotationally driven, or a combination thereof. The head cap 12 is moved to enter a space formed on the printing table 11 from the right side to the left side and is positioned directly below the ink discharge surface 21 when the line head 20 is lifted and positioned at the standby position (the position shown in FIG. 2). Further, the ink discharge surface 21 is covered with the head cap 12 in a standby state where printing is not performed. Accordingly, the head cap 12 prevents ink from being dried and prevents dust or paper powder from being attached to the ink discharge surface in the standby state, so that the clogging of nozzles 32 (not shown) is prevented. Meanwhile, in order to improve sealability between the head cap and the ink discharge surface 21, the head cap 12 is formed by arranging rubber caps, which are provided for each of the ink colors, in accordance with the arrangement of the nozzles 32 corresponding to each of the ink colors.

Further, the cleaning device 40 includes an endless cleaning belt 41 (which serves as a liquid adsorbent in the invention) that is made of a porous foam or the like. Furthermore, while the line head 20 is positioned at the cleaning position (the position shown in FIG. 3), the cleaning device enters a space formed on the printing table 11 from the left side to the right side and is moved in order to perform cleaning so that the ink discharge surface 21 and the cleaning belt 41 face each other. After that, the cleaning device wipes off waste ink or the like attached to the ink discharge surface 21 by making the cleaning belt 41 come into contact with the ink discharge surface 21 and moving the cleaning belt in a direction perpendicular to the plane of FIG. 3, and adsorbs the waste ink or the like. Meanwhile, the cleaning belt 41 may be made of nonwoven fabric, condensed chemical fiber, or the like other than the porous foam.

[Configuration Example of Liquid Discharge Head]

Figure 4:
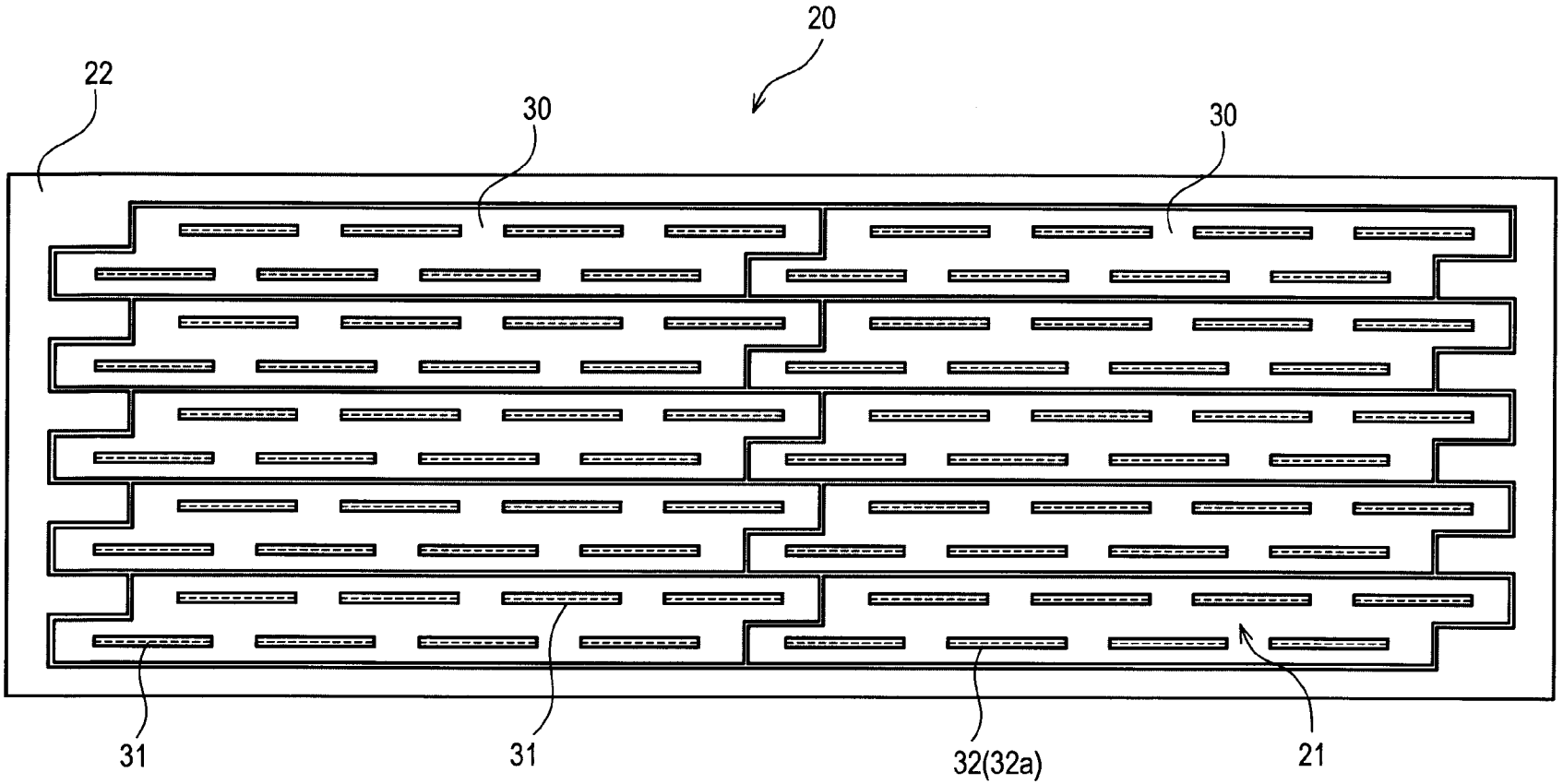
FIG. 4 is a plan view of a line head of the inkjet printer shown in FIGS. 1 to 3, and is a view as seen from an ink discharge surface.

FIG. 4 is a plan view of the line head 20 of the inkjet printer 10 shown in FIGS. 1 to 3, and is a view as seen from the ink discharge surface 21.

As shown in FIG. 4, the line head 20 includes a head frame 22 and a plurality of head modules 30 that is held by the head frame 22. Specifically, two head modules 30 are connected in series in the longitudinal direction of the head frame 22 (the sheet width direction), and are inserted into the head frame 22. Further, the two head modules 30 cover the width of a printable maximum-size recording sheet (for example, the width of an A4 sheet), and print the recording sheet with one color. Furthermore, five lines, each of which is formed by the two head modules 30 connected in series, (total ten head modules) are provided parallel to each other, and form a full-color image by discharging Y (yellow), M (magenta), C (cyan), and K (black) inks, respectively.

In addition, each of the head modules 30 is provided with a plurality of head chips 31. Specifically, eight head chips 31 are disposed in zigzags in the form of a 4-by-2 matrix in each of the head modules 30. Further, in each of the head chips 31, a plurality of nozzles 32 for discharging ink is arranged in one direction so as to form a nozzle array 32*a*. For this reason, nozzle arrays 32*a* are disposed in two lines in each of the head modules 30 so as to be parallel to each other, the respective nozzles 32 are arranged along the length of the recording sheet in the width direction of the sheet, and the nozzle arrays are disposed in ten lines in parallel in the entire line head 20. A portion of the line head where the nozzle arrays 32*a* are formed (a surface of the line head where the nozzle arrays 32*a* are formed) forms the ink discharge surface 21. Meanwhile, a distance between the nozzles 32 is the same in all of the head chips that are adjacent to each other in zigzags.

Figure 5:
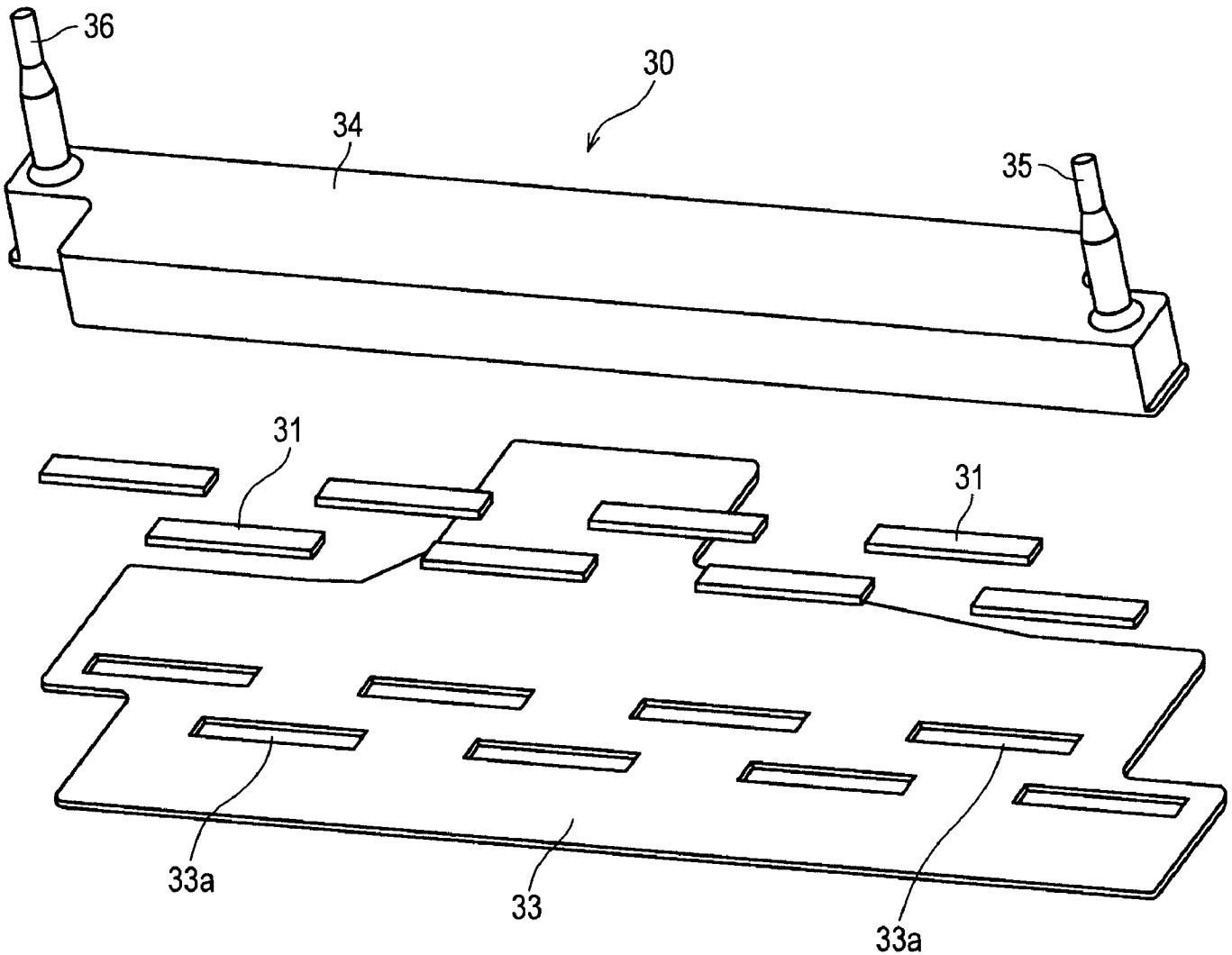
FIG. 5 is an exploded perspective view of each head module of the line head shown in FIG. 4.

FIG. 5 is an exploded perspective view of each head module 30 of the line head 20 shown in FIG. 4.

As shown in FIG. 5, the head module 30 includes eight head chips 31, a flexible sheet 33 on which the respective head chips 31 are disposed, and an ink tank 34. Meanwhile, the ink discharge surface 21 shown in FIG. 4 is the lower surface of the flexible sheet 33 shown in FIG. 5.

Here, the flexible sheet 33 is a flexible wiring board that electrically connects the head chip 31 to a control board (not shown), and is made of polyimide and has a thickness of about 50 μm. Further, openings 33*a* are formed in zigzags at the flexible sheet 33. Furthermore, each of the head chips 31 is connected to the flexible sheet 33 so that all the nozzles 32 (see FIG. 4) are positioned in the opening 33*a* and the head chip 3L closes the opening 33*a*.

Moreover, the ink tank 34 is bonded onto the flexible sheet 33 so as to cover the respective head chips 31. The ink tank 34 forms a common flow passage through which ink is supplied to the respective head chips 31. Further, the ink tank includes an ink supply port 35 which is connected to an ink cartridge (not shown) and through which ink is supplied to the common flow passage, and an ink discharge port 36 through which ink in the common flow passage is discharged. For this reason, the ink stored in the cartridge flows in the common flow passage of the ink tank 34 through the ink supply port 35, and is supplied to the respective head chips 31. Meanwhile, when the head module 30 is inserted into the head frame 22 (see FIG. 4), a portion of the flexible sheet 33 protruding from the head module 30 is bent along the side surface of the ink tank 34.

Figure 6A:
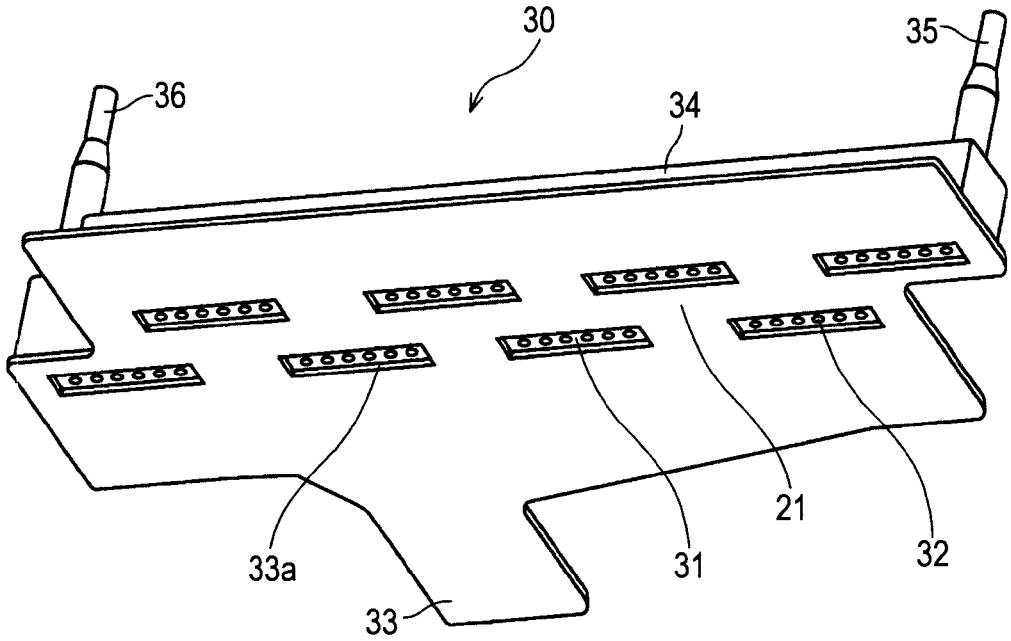
FIG. 6A is a perspective view of the head module shown in FIG. 5 as seen from the ink discharge surface.
Figure 6B:
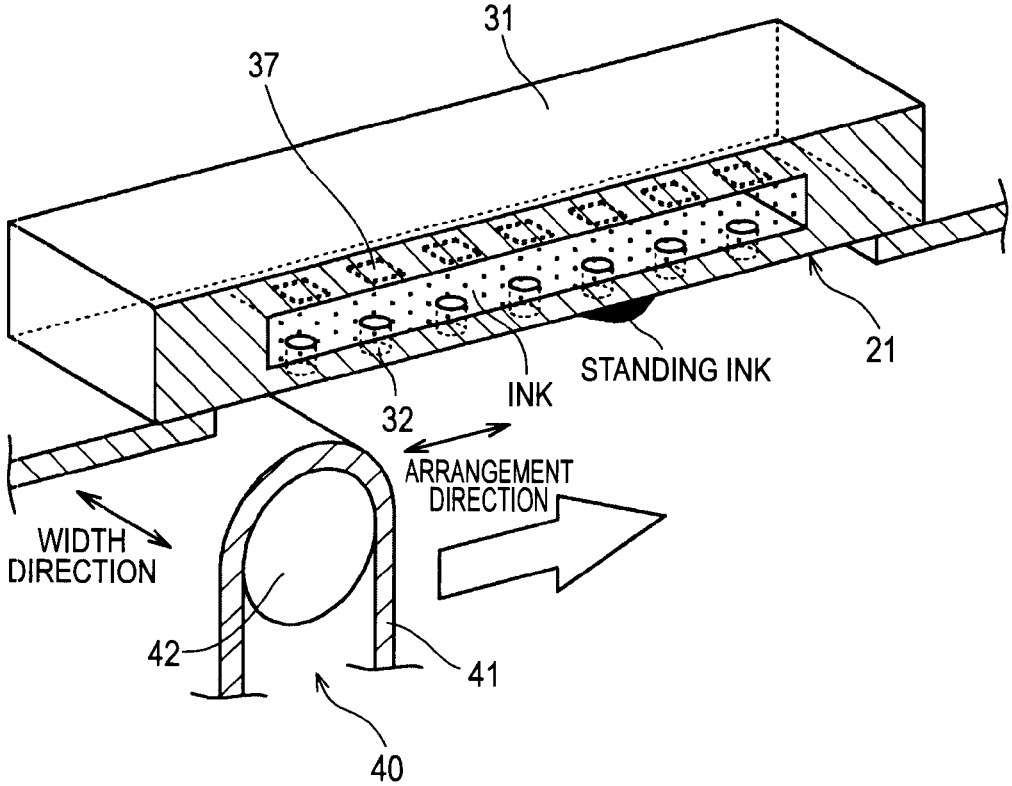
FIG. 6B is a cross-sectional view of a peripheral portion of each head chip.

FIG. 6A is a perspective view of the head module 30 shown in FIG. 5 as seen from the ink discharge surface 21, and FIG. 6B is a cross-sectional view of a peripheral portion of each head chip 31.

As shown in FIG. 6A, the head module 30 is formed by disposing eight head chips 31 in zigzags in an internal space between the flexible sheet 33 and the ink tank 34. Further, all the nozzles 32 of each of the head chips 31 are positioned in the opening 33*a* of the flexible sheet 33. For this reason, the ink discharge surface 21 is formed of the surface of the flexible sheet 33 except for the openings 33*a* and surfaces of the head chips 31 positioned in the openings 33*a*.

Furthermore, as shown in FIG. 6B, the head chip 31 includes a plurality of heating resistors 37 that is arranged at positions facing the respective nozzles 32, and a space between each of the nozzles 32 and each of the heating resistors 37 forms a liquid chamber for ink. Further, when ink is supplied from the ink supply port 35 (see FIG. 6A), not only spaces around the head chips 31 but also the liquid chambers of the head chips 31 are filled with ink.

Here, when pulse current flows in the heating resistor 37 through the flexible sheet 33 (see FIG. 6A) in a short time (for example, 1 to 3 microseconds) by a command sent from the control board (not shown), the heating resistor 37 is rapidly heated. For this reason, bubbles of ink are generated (ink is boiled) at a portion coming into contact with the heating resistor 37, and ink having a predetermined volume is pushed by the expansion of the bubbles. As a result, this becomes discharge pressure, and ink having the same volume as the volume of the pushed ink is discharged from the nozzle 32.

As described above, the head chip 31 discharges ink from the nozzles 32 by heating the heating resistor 37, and forms an image on the recording sheet that is fed directly below the nozzles 32. For this reason, while ink is repeatedly discharged, standing ink may be generated on the ink discharge surface 21 or dirt or foreign materials may be attached to the ink discharge surface. Further, if this state is left out, the discharge of ink from the nozzle 32 is hindered, which causes discharge failure, such as nondischarge or incomplete discharge.

Furthermore, standing ink corresponding to different colors are also attached to the ink discharge surface 21 in the line head 20 (see FIG. 4) that manages full color. For this reason, the standing ink, which has a color different from the colors of existing ink stored in the head module 30, may flow back from the nozzles 32. In addition, the color of the standing ink is mixed to the colors of the existing ink, so that mixed color ink is discharged. Therefore, the deterioration of image quality, such as change in concentration, deviation in hue, and stripe unevenness, is caused.

Accordingly, the cleaning device 40 shown in FIG. 6B is provided to wipe off the standing ink and the like from the ink discharge surface 21. The cleaning device 40 includes an endless cleaning belt 41 and installation rollers 42 (which serves as support rollers in the invention) where the cleaning belt 41 is rotatably installed. The cleaning belt 41 is provided so that an angle (90° in this embodiment) is formed between the width direction of the cleaning belt and the arrangement direction of the nozzles 32. Further, the cleaning belt 41, which is positioned on the peripheral surface of the installation roller 42, comes into contact with the ink discharge surface 21. Furthermore, the width of the cleaning belt 41 is slightly larger than a distance between both outer nozzle arrays 32*a* of the ten nozzle arrays that are disposed in parallel in the transverse direction of the line head 20 shown in FIG. 4. Accordingly, as shown in FIG. 3, the cleaning belt 41 has a width capable of covering the entire width of the ink discharge surface 21.

The cleaning belt 41 of the cleaning device 40 is moved in the arrangement direction of the nozzles 32 by a moving unit that moves the cleaning belt 41 along an arrow that is obliquely inclined toward the right upper side in FIG. 6B. Accordingly, the cleaning belt wipes off the standing ink and the like that are attached to the ink discharge surface 21. Meanwhile, the cleaning belt 41 is rotatably installed around the installation rollers 42, but is not rotated while being moved.

Here, the ink discharge surface 21 of the line inkjet printer including the line head 20 (see FIG. 4) is very much larger than that of a serial inkjet printer that performs printing while moving a head. For this reason, a cleaning range is large and the amount of ink to be sucked is increased in the case of the line inkjet printer. Therefore, there is a problem in the reverse transfer of ink to the ink discharge surface 21. Specifically, although standing ink and the like of the ink discharge surface 21 are adsorbed well at a cleaning start position, adsorbability is decreased as a position approaches a cleaning end position. As a result, a portion of the ink discharge surface 21, which is to be cleaned later, is typically contaminated. Accordingly, there is a high possibility that positions where the discharge failure of ink is caused may be concentrated on the portion of the ink discharge surface to be cleaned later. In this embodiment, a belt-shaped porous foam (cleaning belt 41) of which the ink adsorption capacity is larger than the ink adsorption capacity of a roller-shaped porous foam (cleaning roller) is used in order to prevent this problem. Since which of the cleaning belt or the cleaning roller is used depends on adsorption capacity, the cleaning roller may be used without limitation on the cleaning belt 41.

Figure 7A:
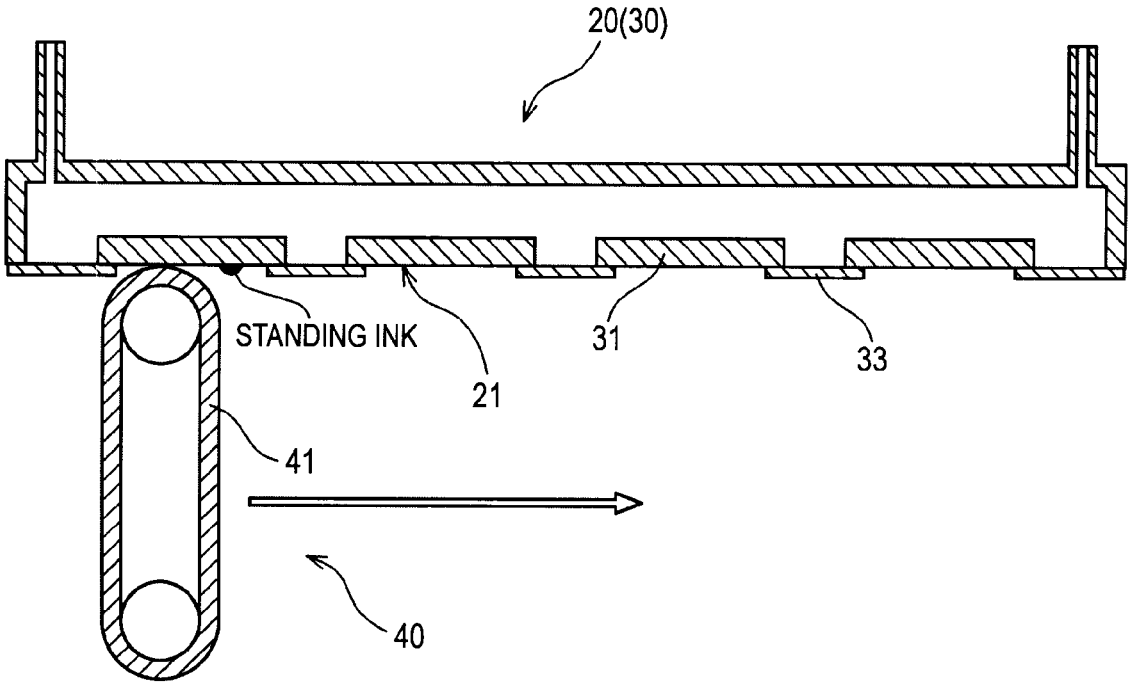
FIGS. 7A and 7B are cross-sectional views showing a state where the ink discharge surface of the line head shown in FIG. 4 is being cleaned, as seen from the side surface.
Figure 7B:
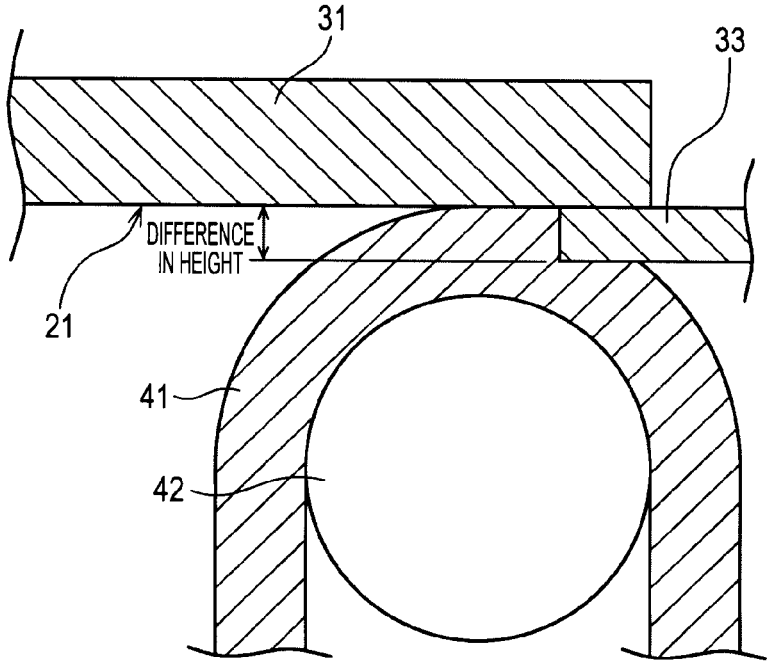

FIGS. 7A and 7B are cross-sectional views showing a state where the ink discharge surface 21 of the line head 20 shown in FIG. 4 is being cleaned, as seen from the side surface.

As shown in FIG. 7A, the cleaning belt 41 slides on the ink discharge surface 21 in a direction of an arrow. Accordingly, standing ink, dirt, foreign materials, and the like, which are attached to the ink discharge surface 21, are wiped off by the movement of the cleaning belt 41 like a wiper.

Here, as shown in FIG. 7B, a stepped portion (a stepped portion having a difference in height of about 50 μm in this embodiment) between the head chip 31 and the flexible sheet 33 is formed on the ink discharge surface 21. However, the cleaning belt 41 is made of an open cell porous foam that has flexibility, water adsorbability, and air permeability. Accordingly, a portion positioned on the peripheral surface of the installation roller 42 follows the stepped portion. For this reason, a gap is not formed at a corner of the stepped portion, and it may be possible to almost completely adsorb residual ink and the like existing at the corner of the stepped portion by a synergistic effect of this and a capillary force of a pore (cell) formed in the porous foam.

Further, even when the number of head modules 30, which are connected in series, is increased in order to increase the width of a printable recording sheet (for example, in order to increase the width of an A4 sheet to the width of an A3 sheet), it is not necessary to change the width of the cleaning belt 41 of the cleaning device 40 of this embodiment. In other words, even though the width of the recording sheet is increased, it may be possible to clean the line head by increasing the moving distance of the cleaning belt without changing the width of the cleaning belt 41. For this reason, it may be possible to avoid the increase in the size of the cleaning device 40.

Furthermore, the endless cleaning belt 41 is rotatably supported by the installation rollers 42. For this reason, a contact portion of the cleaning belt 41, which comes into contact with the ink discharge surface 21 and is contaminated by the wiping-off, may be changed by the rotational drive of the installation roller 42. Accordingly, it may be possible to use a fresh portion of the cleaning belt, which is not contaminated, at the time of the next cleaning.

Figure 8:
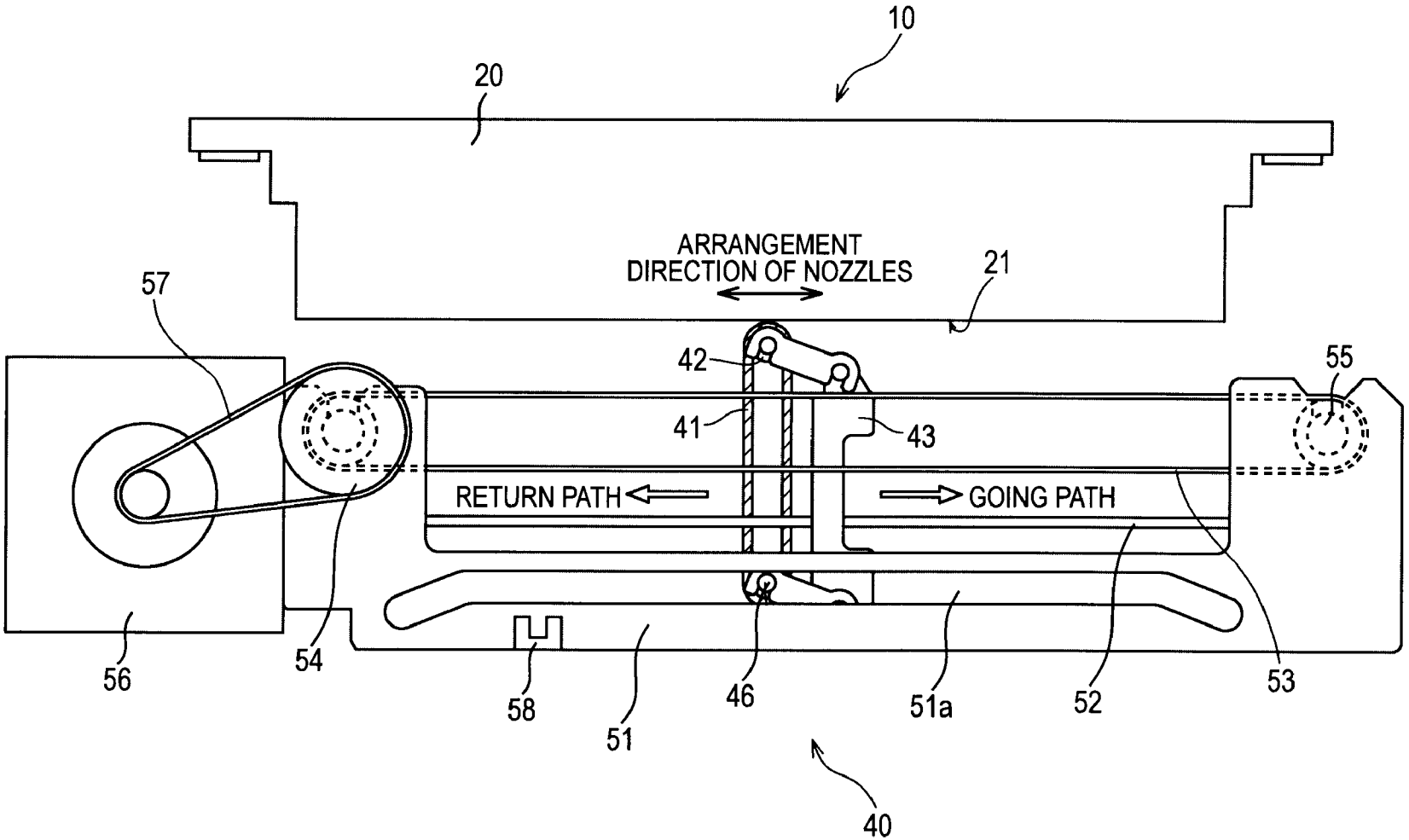
FIG. 8 is a side view of a cleaning device of the inkjet printer as the liquid discharge apparatus according to the embodiment of the invention.

FIG. 8 is a side view of the cleaning device 40 of the inkjet printer 10 as the liquid discharge apparatus according to the embodiment of the invention.

In order to clean the ink discharge surface 21 of the line head 20, the cleaning belt 41 is installed so as to be rotated by the installation rollers 42 as shown in FIG. 8. Further, the installation rollers 42 are supported by a belt frame 43 (which serves as a slide part and a swing part in the invention). Furthermore, the cleaning belt 41 is provided in the belt frame 43 so that an angle (90° in this embodiment) is formed between the width direction of the cleaning belt and the arrangement direction of the nozzles. In addition, the belt frame 43 is reciprocated in the arrangement direction of the nozzles by a moving unit that moves the belt frame 43 along a horizontal arrow shown in FIG. 8. Meanwhile, in FIG. 8, a right direction corresponds to a going path and a left direction corresponds to a return path. However, a right direction may correspond to a return path and a left direction may correspond to a going path.

The moving unit for the belt frame 43 may be formed of, for example, a piston, a cam, a belt, a gear to be rotationally driven, or a combination thereof. Further, in this embodiment, the moving unit for the belt frame 43 includes a belt driving motor 56, a movement transmitting belt 57, guide shafts 52, a moving drive belt 53, a moving drive pulley 54, and a tension pulley 55 that are provided in a base frame 51. Meanwhile, since it is preferable that the cleaning belt 41 be moved relative to the ink discharge surface 21, there may be provided a moving unit that moves the line head 20.

Here, the belt frame 43 is formed by the combination of a support made of a resin and a frame made of a metal sheet. Two guide shafts 52, which are provided in parallel to the longitudinal direction of the base frame 51, are inserted into the support. For this reason, the belt frame 43 is movable in the longitudinal direction of the base frame 51 while being supported by the guide shafts 52. Further, the moving drive belt 53 is fixed to the support of the belt frame 43. Furthermore, the moving drive belt 53 is installed parallel to the guide shafts 52 between the moving drive pulley 54 that is provided at one end of the base frame 51 and the tension pulley 55 that is provided at the other end of the base frame.

The moving drive pulley 54 is rotationally driven through the movement transmitting belt 57 by the belt driving motor 56. For this reason, when the belt driving motor 56 is driven in a normal or reverse direction, the moving drive pulley 54 is also rotated in the normal or reverse direction and may rotate the moving drive belt 53. Accordingly, as the belt driving motor 56 is driven in the normal or reverse direction, the belt frame 43 is reciprocated along the guide shafts 52 at a speed that corresponds to the rotation speed of the moving drive belt 53. Further, cleaning is completed by one reciprocating motion, and a home position (reference position) of the belt frame 43 is detected by a position sensor 58 that is provided on the base frame 51.

Furthermore, a guide groove 51*a* (which serves as a guide portion in the invention) is formed at the base frame in the longitudinal direction of the base frame 51. A guide roller 46, which is provided on the same axis of rotation as the axis of rotation of the lower installation roller 42, is inserted into the guide groove 51*a*. The guide roller 46 is guided by the guide groove 51*a*. Further, the guide groove 51*a* is inclined downward at positions that pass the home position (the cleaning start position close to the moving drive pulley 54) and the end position (the cleaning end position close to the tension pulley 55) of the belt frame 43. For this reason, if the guide roller 46 passes the home position or the end position, the guide roller 46 is pushed down by the guide groove 51*a*. Meanwhile, the guide roller 46 is horizontally guided by the guide groove 51*a* at the middle position (between the cleaning start position and the end position).

Figure 9:
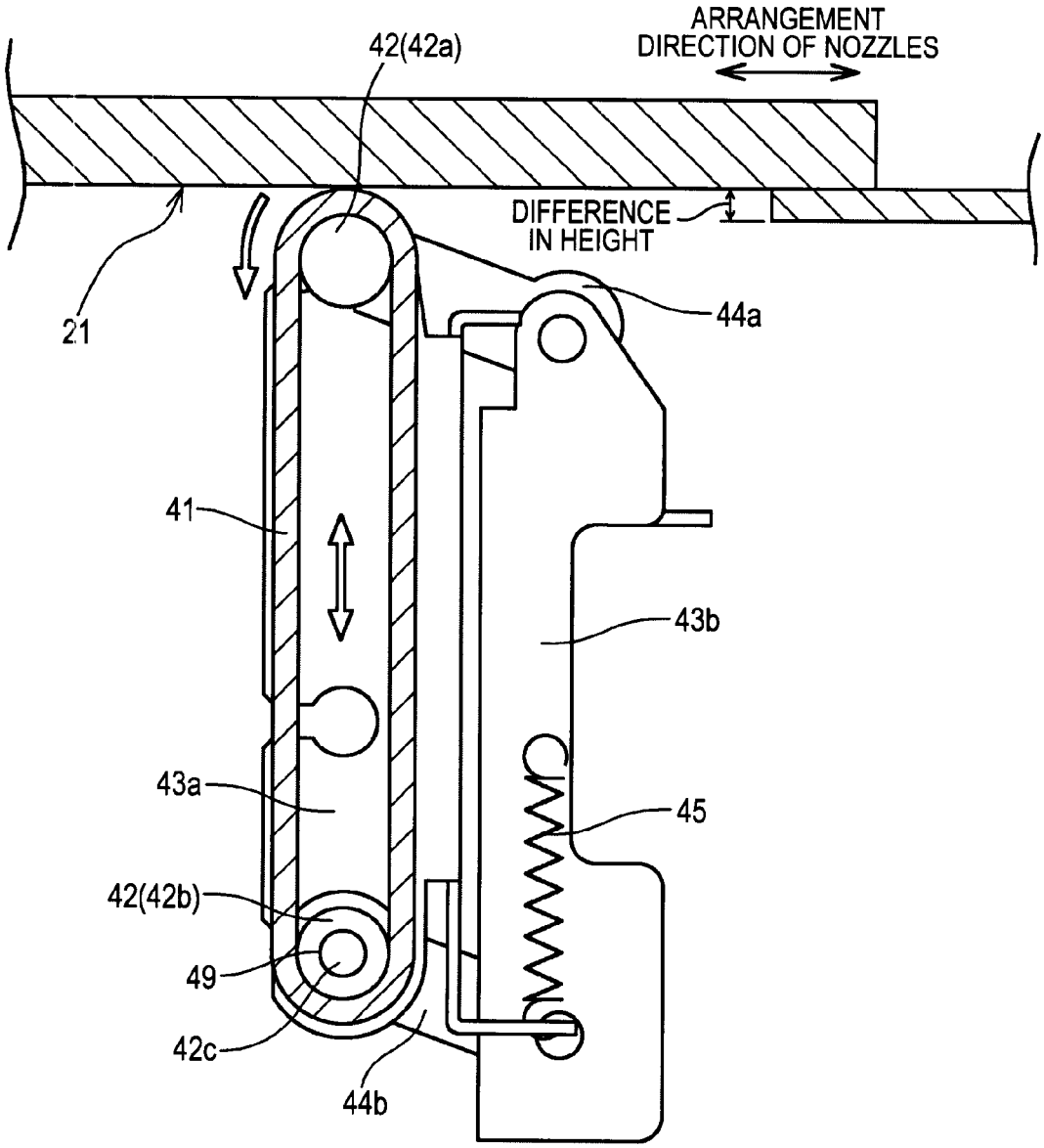
FIG. 9 is a side view of a peripheral portion of a cleaning belt of the cleaning device shown in FIG. 8.

FIG. 9 is a side view of a peripheral portion of the cleaning belt 41 of the cleaning device 40 shown in FIG. 8.

Figure 10:
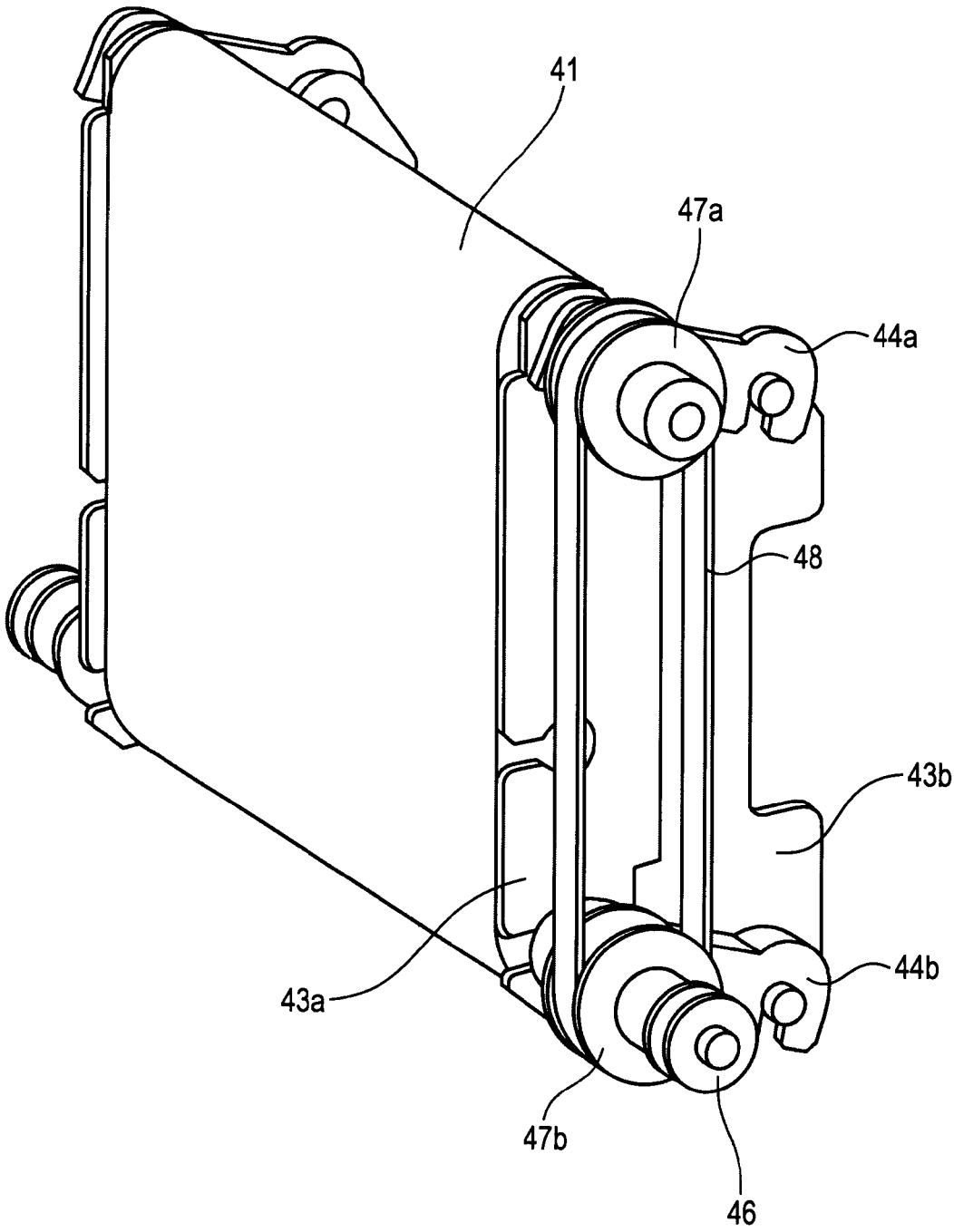
FIG. 10 is a perspective view of the peripheral portions of the cleaning belt of the cleaning device shown in FIG. 8.

Further, FIG. 10 is a perspective view of the peripheral portions of the cleaning belt 41 of the cleaning device 40 shown in FIG. 8.

As shown in FIG. 9, the cleaning belt 41 is installed so that an appropriate tension is applied to the cleaning belt by the pair of (upper and lower) installation rollers 42 (installation rollers 42*a* and 42*b*). Further, the installation rollers 42*a* and 42*b* are rotatably supported by the belt frame 43*a* (which serves as a swing part in the invention). For this reason, the endless cleaning belt 41 is rotated by the rotation of the installation rollers 42*a* and 42*b*.

Furthermore, a rotation transmitting pulley 47*a* (see FIG. 10) is fixed to the upper installation roller 42*a*, and a rotation transmitting pulley 47*b* (see FIG. 10) is fixed to the lower installation roller 42*b*. Moreover, a rotation transmitting belt 48 (see FIG. 10) is installed between the rotation transmitting pulleys 47*a* and 47*b*. For this reason, when the rotation transmitting pulley 47*b* is rotated by the rotation of the lower installation roller 42*b*, the torque of the rotation transmitting pulley is transmitted to the rotation transmitting 48*a* through the rotation transmitting belt 48, so that the upper installation roller 42*a* is also rotated. Meanwhile, the guide roller 46 (see FIG. 10) is rotatably mounted on the lower rotation transmitting pulley 47*b*.

In addition, the belt frame 43*a*, which supports the installation rollers 42*a* and 42*b*, is swingably supported by a belt frame 43*b* (which serves as a slide part in the invention) through the upper and lower links 44*a* and 44*b*. For this reason, the belt frame 43*a* is mounted on the belt frame 43*b* by a four-node link mechanism and can be lifted and lowered with respect to the belt frame 43*b*. Accordingly, the cleaning belt 41, which is installed between the installation rollers 42*a* and 42*b*, can be rotated and moved up and down together with the belt frame 43*a* along a vertical arrow so as to be parallel to the belt frame 43*b*.

Here, the belt frame 43*a* is pushed upward by a push-up spring 45 so that a portion of the cleaning belt 41, which is positioned on the peripheral surface of the upper installation roller 42*a*, comes into contact with the ink discharge surface 21 at a predetermined pressure. Accordingly, even though stepped portions are formed on the ink discharge surface 21, the belt frame 43*a* (the installation rollers 42*a* and 42*b*) is moved up and down along a vertical arrow. As a result, the cleaning belt 41 can follow the stepped portions of the ink discharge surface 21.

Meanwhile, when the belt frame 43*a* is moved up and down, the upper and lower links 44*a* and 44*b* are rotated. Further, a rotating shaft 42*c* is fixed to the lower link 44*b*. The rotating shaft 42*c* corresponds to the axis of rotation of the lower installation roller 42*b*, and is a component of a lower journal portion, which is disposed at the belt frame 43*a*, of the four-node link mechanism. For this reason, when the lower link 44*b* is rotated, the belt frame 43*a* is moved up and down and the rotating shaft 42*c* is also rotated.

Furthermore, a one-way clutch 49 (which serves as a reverse rotation preventing unit in the invention) is provided between the rotating shaft 42*c* and the installation roller 42*b*. The one-way clutch 49 is formed by a combination of gears, cams, and clicks. The one-way clutch transmits the normal rotation of the rotating shaft 42*c* to the installation roller 42*b*, and does not transmit the reverse rotation of the rotating shaft to the installation roller 42*b*. Meanwhile, in this embodiment, the counterclockwise rotation of the rotating shaft 42*c* is referred to as the normal rotation and the clockwise rotation of the rotating shaft is referred to as the reverse rotation.

Accordingly, since the rotating shaft 42*c* is rotated in a counterclockwise direction (normal direction) when the lower link 44*b* is rotated downward, the installation roller 42*b* is also rotated in the counterclockwise direction by the one-way clutch 49. As a result, the cleaning belt 41 is rotated along a counterclockwise arrow. In contrast, since the rotating shaft 42*c* is rotated in a clockwise direction (reverse direction) when the lower link 44*b* is rotated upward, the installation roller 42*b* is not rotated by the one-way clutch 49. For this reason, the cleaning belt 41 is also not rotated. Therefore, the cleaning belt 41 is rotated in only one direction by the rotation of the lower link 44*b*. Meanwhile, the timing of the up and down movement of the cleaning belt 41 and the rotation angle of the cleaning belt are determined by the guide groove 51*a* (see FIG. 8).

Figure 11:
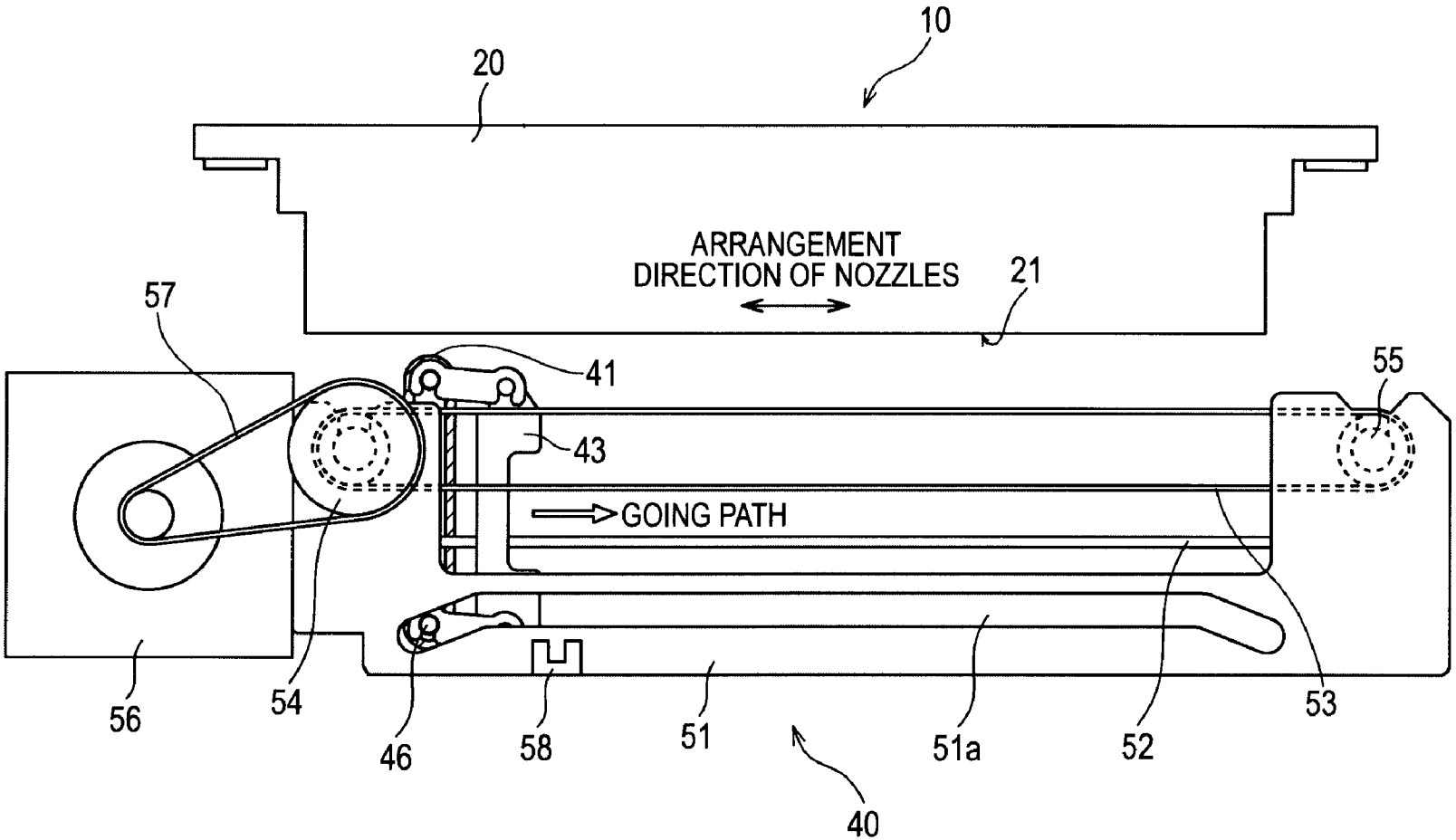
FIG. 11 is a side view showing the progress of the cleaning of the ink discharge surface of the inkjet printer shown in FIG. 8, and shows the state of the inkjet printer before cleaning starts.

FIG. 11 is a side view showing the progress of the cleaning of the ink discharge surface 21 of the inkjet printer 10 shown in FIG. 8, and shows the state of the inkjet printer before cleaning starts.

Figure 12:
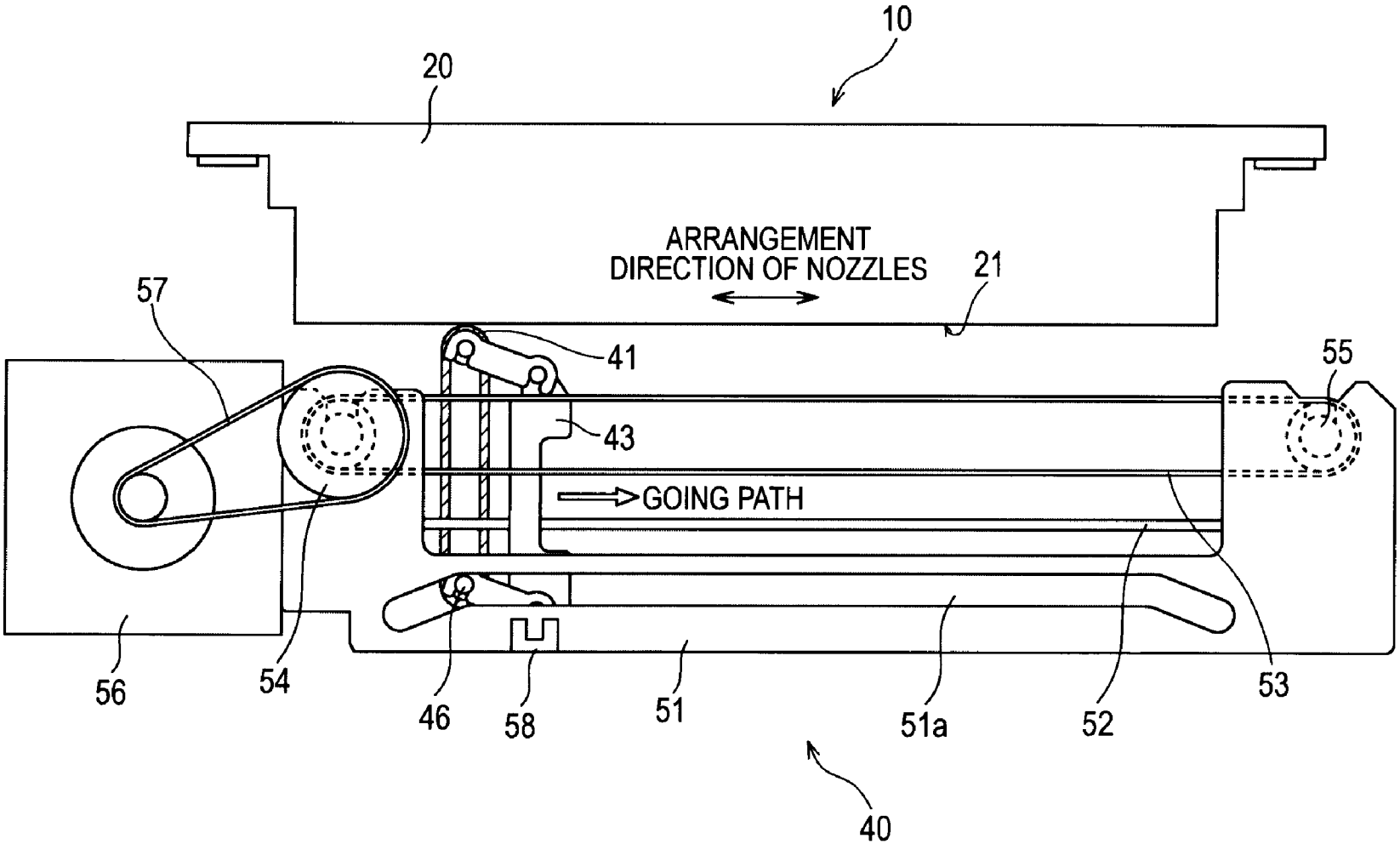
FIG. 12 is a side view showing the progress of the cleaning of the ink discharge surface of the inkjet printer shown in FIG. 8, and shows the state of the inkjet printer when cleaning starts.

FIG. 12 is a side view showing the progress of the cleaning of the ink discharge surface 21 of the inkjet printer 10 shown in FIG. 8, and shows the state of the inkjet printer when cleaning starts.

Figure 13:
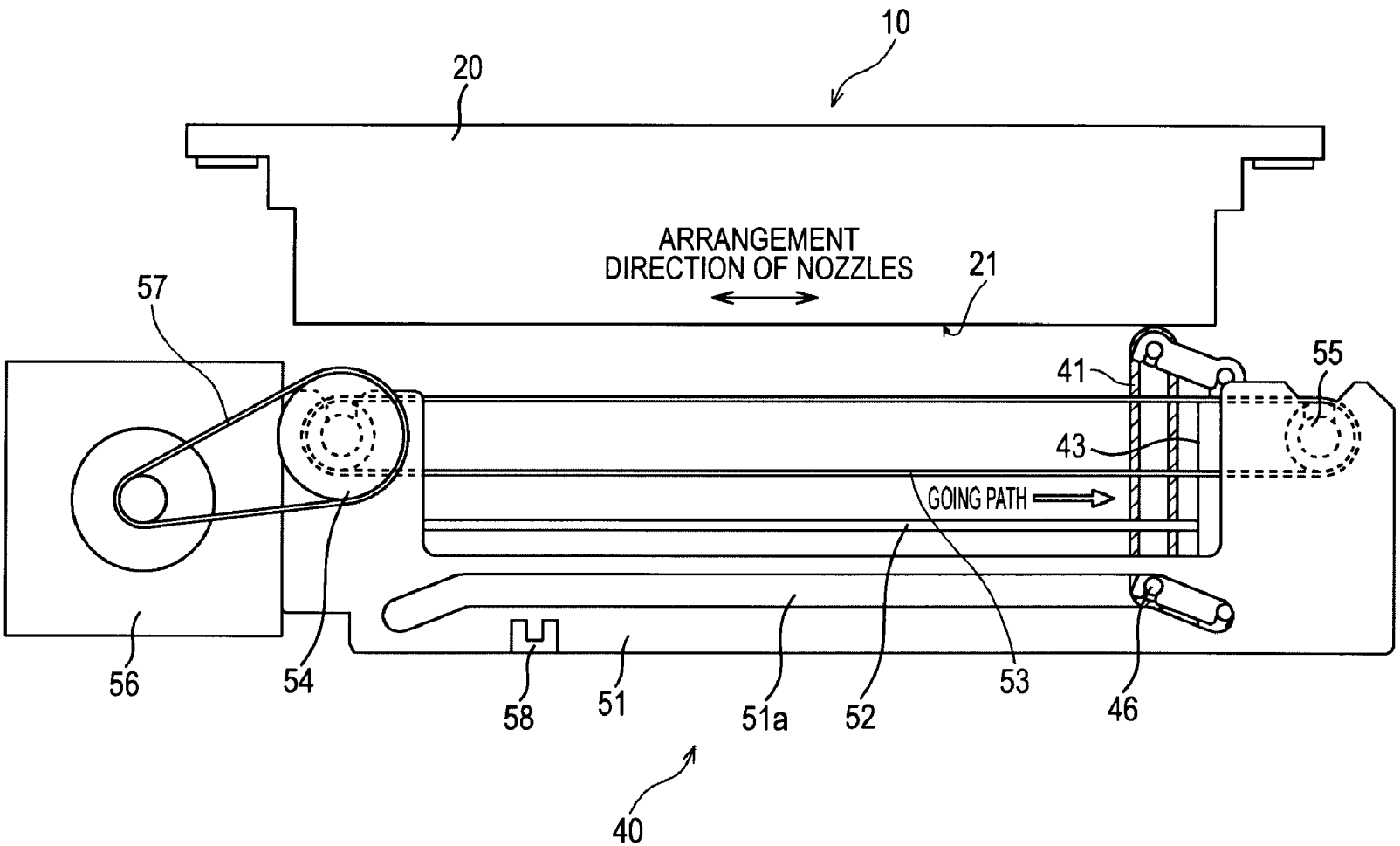
FIG. 13 is a side view showing the progress of the cleaning of the ink discharge surface of the inkjet printer shown in FIG. 8, and shows the state of the inkjet printer when cleaning is completed.

FIG. 13 is a side view showing the progress of the cleaning of the ink discharge surface 21 of the inkjet printer 10 shown in FIG. 8, and shows the state of the inkjet printer when cleaning is completed.

Figure 14:
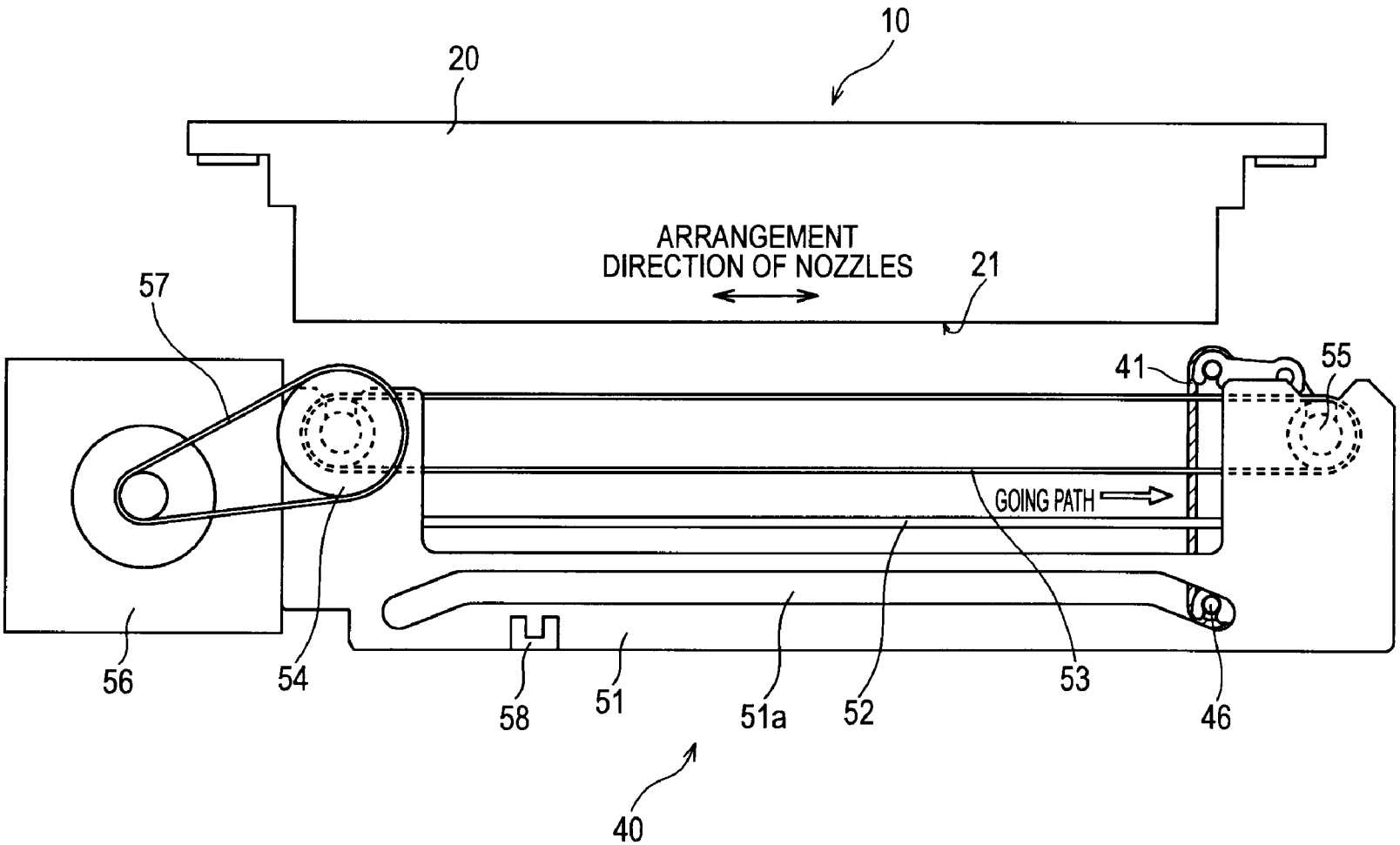
FIG. 14 is a side view showing the progress of the cleaning of the ink discharge surface of the inkjet printer shown in FIG. 8, and shows the state of the inkjet printer after cleaning is completed.
Figure 15A:
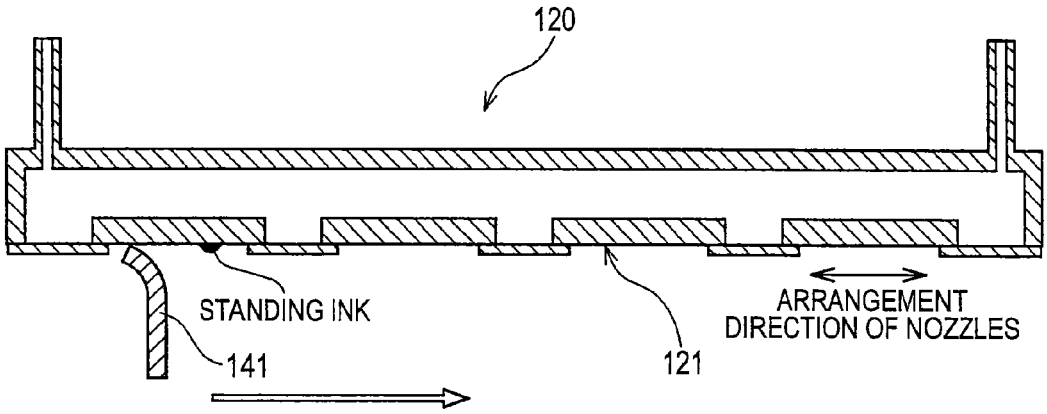
FIGS. 15A and 15B are cross-sectional views showing a state where a line head is being cleaned by a rubber blade method in the related art, as seen from the side surface.
Figure 15B:
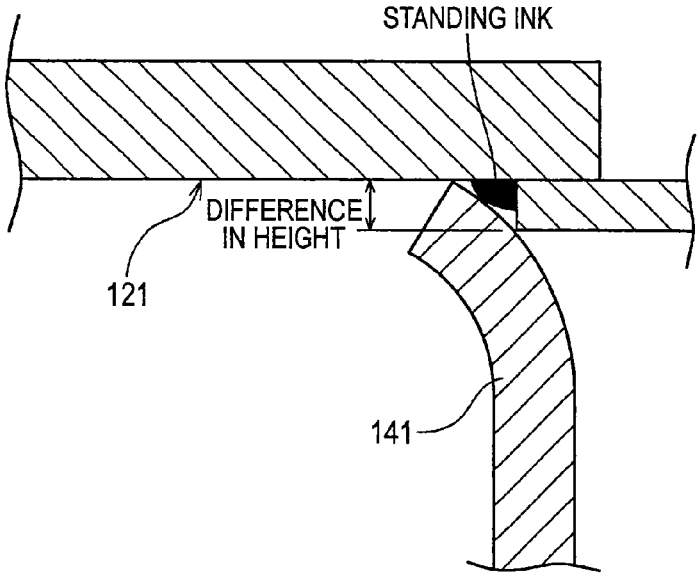
FIG.15B RELATED ART

FIG. 14 is a side view showing the progress of the cleaning of the ink discharge surface 21 of the inkjet printer 10 shown in FIG. 8, and shows the state of the inkjet printer after cleaning is completed.

Before cleaning starts, as shown in FIG. 11, the belt frame 43 is positioned closer to the moving drive pulley 54 than the position sensor 58. Further, when the belt frame is positioned at this position, the guide roller 46 is positioned at a downward inclined portion of the guide groove 51*a*. Here, the guide roller 46 is rotatably mounted on the rotation transmitting pulley 47*b* (see FIG. 10), and the rotation transmitting pulley 47*b* is fixed to the installation roller 42*b* (see FIG. 9). Further, the installation roller 42*b* is pushed upward through the belt frame 43*a* (see FIG. 9) by the push-up spring 45 (see FIG. 9). Accordingly, in the state of the inkjet printer shown in FIG. 11 before cleaning starts, the guide roller 46 (installation roller 42*b*) is pushed down due to the guide groove 51*a* against the pushing force of the push-up spring 45. For this reason, the cleaning belt 41 is separated from the ink discharge surface 21.

After that, the belt driving motor 56 is rotationally driven in order to start cleaning, so that the belt frame 43 is moved along the going path (in a direction indicated by a rightward arrow). Accordingly, the guide roller 46, which is being pushed upward, is lifted along the inclined portion of the guide groove 51*a*. For this reason, in the state of the inkjet printer shown in FIG. 12 when cleaning starts, the cleaning belt 41 comes into contact with the ink discharge surface 21 at a predetermined pressure. Further, the position of the belt frame 43 shown in FIG. 12 is the home position that is the start reference of cleaning corresponding to the going path. Meanwhile, the position sensor 58 detects that the belt frame 43 is positioned at the home position.

Furthermore, when the guide roller 46 is lifted along the inclined portion of the guide groove 51*a*, the lower link 44*b* shown in FIG. 9 is rotated upward and the rotating shaft 42*c* is rotated in the clockwise direction (reverse direction). However, the reverse rotation of the rotating shaft 42*c* is not transmitted to the installation roller 42*b* by the one-way clutch 49. For this reason, while the belt frame 43 is moved to the position (home position) shown in FIG. 12 when cleaning starts from the position shown in FIG. 11 before cleaning starts, the cleaning belt 41 is not rotated.

In order to clean the ink discharge surface 21 of the inkjet printer 10 (line head 20) by the cleaning belt 41, the belt frame 43 is further moved along the going path by rotationally driving the belt driving motor 56. Specifically, the belt frame 43 is moved to the position (end position) shown in FIG. 13 when cleaning is completed from the position (home position) shown in FIG. 12 when cleaning starts. Meanwhile, during this movement of the belt frame, the number of pulses, which rotationally drive the belt driving motor 56, is counted from the home position as reference.

The guide groove 51*a* is formed between the home position and the end position so as to be parallel to the ink discharge surface 21. For this reason, the guide roller 46 is not moved up and down, so that the cleaning belt 41 is moved horizontally along the ink discharge surface 21. Further, since the lower link 44*b* (see FIG. 9) is not rotated, the installation roller 42*b* (see FIG. 9) is not rotated. Accordingly, the ink discharge surface 21 is rubbed by the cleaning belt like a wiper through the movement of the cleaning belt 41 without the rotation of the cleaning belt 41, so that the ink contamination, dirt, foreign materials and the like are sequentially wiped off from the ink discharge surface 21.

Here, as shown in FIG. 9, a stepped portion is formed on the ink discharge surface 21. However, the cleaning belt 41, which is moved up and down and is made of a porous foam having flexibility, water adsorbability, and air permeability, follows the stepped portion. For this reason, a gap is not formed between the corner of the stepped portion and a portion of the cleaning belt 41 that is positioned on the peripheral surface of the installation roller 42*a*, and it may be possible to almost completely wipe off residual ink and the like existing at the corner of the stepped portion by a synergistic effect of this and a capillary force of a pore (cell) formed in the porous foam.

Accordingly, the belt frame 43 is moved to the end position shown in FIG. 13 from the home position shown in FIG. 12, so that the ink discharge surface 21 is cleaned. Therefore, the cleaning corresponding to the going path is completed. Meanwhile, the movement of the belt frame 43 to the end position is detected by the counting of the number of pulses, which rotationally drive the belt driving motor 56, up to a predetermined value.

Further, the inkjet printer 10 according to this embodiment performs cleaning even when the belt frame 43 is returned to the home position. However, the contact portion of the cleaning belt 41, which comes into contact with the ink discharge surface 21, is contaminated by the wiping-off. For this reason, the wiping portion is changed by rotating the cleaning belt 41 by a desired angle.

The belt frame 43 is further moved along the going path by rotationally driving the belt driving motor 56, so that the wiping portion of the cleaning belt 41 is changed. Specifically, the belt frame 43 is moved to the position shown in FIG. 14 after cleaning is completed from the position (end position) shown in FIG. 13 when cleaning is completed. Meanwhile, the number of pulses, which rotationally drive the belt driving motor 56, is counted during this movement of the belt frame.

Further, when the belt frame is positioned at the position shown in FIG. 14 after cleaning is completed, the guide roller 46 is positioned at a downward inclined portion of the guide groove 51*a*. For this reason, when the belt frame 43 is moved from the end position to the tension pulley 55, the guide roller 46 is pushed down due to the inclined portion of the guide groove 51*a*. As a result, the cleaning belt 41, which has cone into contact with the ink discharge surface 21, is separated from the ink discharge surface 21. Meanwhile, the movement of the belt frame 43 to the position shown in FIG. 14 is detected by the counting of the number of pulses, which rotationally drive the belt driving motor 56, up to a predetermined value.

Further, since the lower link 44*b* shown in FIG. 9 is rotated downward when the guide roller 46 is pushed down due to the inclined portion of the guide groove 51*a*, the rotating shaft 92*c* is rotated in the counterclockwise direction (normal direction). Further, the normal rotation of the rotating shaft 92*c* is transmitted to the installation roller 42*b* by the one-way clutch 49. For this reason, the cleaning belt 41 is rotated by a length corresponding to the angle of the lower link 44*b* that is rotated downward. As a result, since the wiping portion of the cleaning belt 41 is changed, it may be possible to prevent the deterioration of the cleaning performance that is caused when cleaning continues to be performed by the same portion of the cleaning belt. Meanwhile, since the cleaning belt 41 does not come into contact with the ink discharge surface 21 while being rotated, the rotation of the cleaning belt 41 is not affected.

In this case, if the entire portion of the cleaning belt 41 has already come into contact with the ink discharge surface 21 once, a fresh portion does not appear even though the cleaning belt 41 is rotated. For this reason, there is a concern that the cleaning belt is contaminated due to the transfer of the adsorbed ink and the like to the ink discharge surface 21. However, since the front and back surfaces of the cleaning belt 41 come into contact with the air during the time when the contact portion comes into contact with the ink discharge surface again after coming into contact with the ink discharge surface once, air permeability is improved and drying is facilitated. As a result, the water contained in the adsorbed ink is evaporated, so that adsorbability is restored. Accordingly, high cleaning performance is maintained over a long period, and a trouble is not generated even though the cleaning belt 41 is rotated one or more times.

After that, the cleaning belt 41 is moved along the return path (in a direction indicated by a leftward arrow), so as to perform the same cleaning operation (the wiping off of the ink discharge surface 21) as the cleaning operation of the cleaning belt along the going path. Specifically, the belt driving motor 56 is rotationally driven in the reverse direction so that the belt frame 43 is moved along the return path. Accordingly, the guide roller 46, which has been pushed upward at the position shown in FIG. 14, is lifted along the inclined portion of the guide groove 51*a*. For this reason, the state of the inkjet printer returns to the state shown in FIG. 13 from the state shown in FIG. 14, and the cleaning belt 41 comes into contact with the ink discharge surface 21 again.

Further, when the guide roller 46 is lifted along the inclined portion of the guide groove 51*a*, the lower link 44*b* shown in FIG. 9 is rotated upward and the rotating shaft 42*c* is rotated in the clockwise direction (reverse direction). However, the reverse rotation of the rotating shaft 42*c* is not transmitted to the installation roller 42*b* by the one-way clutch 49. For this reason, while the belt frame 43 is returned to the position shown in FIG. 13 from the position shown in FIG. 14, the cleaning belt 41 is not rotated. Accordingly, the cleaning belt 41, of which the wiping portion has already been changed, comes into contact with the ink discharge surface 21.

As described above, the portion of the cleaning belt 41, which is different from the portion of the cleaning belt used for the cleaning corresponding to the going path, comes into contact with the ink discharge surface 21. For this reason, while the belt frame 43 continues to be moved along the return path and is returned to the home position shown in FIG. 12, the ink discharge surface 21 is cleaned by the cleaning belt 41 of which the wiping portion has been changed. Accordingly, without the difference in cleaning performance (adsorbability of the cleaning belt 41), the entire ink discharge surface 21 is uniformly wiped off by the cleaning belt 41 in one reciprocating motion that is performed through the home position, the end position, and the home position. Meanwhile, the home position is detected by the position sensor 58.

Furthermore, the wiping portion of the cleaning belt 41 is changed again for the next cleaning. Specifically, the belt frame 43 is moved along the return path to the position shown in FIG. 11 from the home position shown in FIG. 12. Accordingly, the guide roller 46 is pushed down due to the inclined portion of the guide groove 51*a*, so that the cleaning belt 41 is separated from the ink discharge surface 21. Meanwhile, the movement of the belt frame 43 to the position shown in FIG. 11 is detected by the counting of the number of pulses, which rotationally drive the belt driving motor 56, up to a predetermined value.

In addition, when the guide roller 46 is pushed down due to the inclined portion of the guide groove 51*a*, the lower link 44*b* shown in FIG. 9 is rotated downward and the rotating shaft 42*c* is rotated in the counterclockwise direction (normal direction). Further, the normal rotation of the rotating shaft 42*c* is transmitted to the installation roller 42*b* by the one-way clutch 49. For this reason, the cleaning belt 41 is rotated by a length corresponding to the angle of the lower link 44*b* that is rotated downward. Accordingly, the wiping portion of the cleaning belt 41 is changed again. Meanwhile, it may be possible to adjust the rotation angle and speed of the cleaning belt 41 by changing the height or inclination angle of the inclined portion of the guide groove 51*a*.

As described above, according to the inkjet printer 10 according of this embodiment, the cleaning belt 41 comes into contact with the ink discharge surface 21 at a predetermined pressure and is moved in the arrangement direction of the nozzles. For this reason, it may be possible to clean the ink discharge surface by wiping off the standing ink and the like from the ink discharge surface 21. In addition, the contact portion of the cleaning belt 41, which is used for cleaning and contaminated by the wiping-off, (a portion of which the adsorbability deteriorates) is changed between the going path and the return path by the rotation of the cleaning belt 41. Accordingly, there is no concern that the cleaning belt is contaminated due to the transfer of the adsorbed residual ink and the like to the ink discharge surface 21, and it may be possible to uniformly wipe off the entire ink discharge surface 21.

Further, the cleaning belt 41 is rotated using the movement of the belt frame 43, which is performed by the belt driving motor 56, as a source of power. Specifically, the cleaning belt 41 is rotated little by little by using the operation and timing where the belt frame 43 is moved and the cleaning belt 41 comes into contact with the ink discharge surface 21. Accordingly, it is not necessary that a special motor for rotating the installation roller 42 is provided. As a result, it may be possible to reduce the size of the inkjet printer 10 and to improve the economic efficiency of the inkjet printer. In addition, since a power cable lead from the motor is not moved whenever the cleaning operation is performed, there also is no disconnection trouble that is caused by the repetition of the curvature, friction, and entanglement of the power cable.

Further, the invention is not limited to the above-mentioned embodiment, and may have the following various modifications.

(1) This embodiment has been applied to the line inkjet printer 10 including the line head 20 as the liquid discharge apparatus, but is not limited thereto. However, the liquid discharge apparatus is not limited thereto, and may be a serial printer that performs printing while moving a head in the width direction of a recording sheet. Further, this embodiment may also be applied to a copying machine, a facsimile, and the like in addition to the printer.

(2) The endless cleaning belt 41 made of a foam has been employed as a liquid adsorbent in this embodiment, but a cleaning roller may be employed as a liquid adsorbent. Further, as long as the cleaning belt can adsorb liquid, any material may be used to make the cleaning belt. In this embodiment, cleaning has been completed by one reciprocating motion of the belt frame 43. However, cleaning may be completed by one way motion of belt frame or several reciprocating motions of the belt frame.

(3) The guide shaft 52, the moving drive belt 53, the moving drive pulley 54, the tension pulley 55, the belt driving motor 56, and the movement transmitting belt 57 have been used as the moving unit for the cleaning belt 41 (belt frame 43) in this embodiment. However, the moving unit for the cleaning belt may be formed of a gear, a belt, a cam, a piston, or a combination thereof.

(4) In this embodiment, a one-way clutch 49, which is formed by the combination of gears, cams, and clicks, has been provided between the rotating shaft 42*c* and the installation roller 42*b* as a reverse rotation preventing unit for the installation roller 42*b* (support roller). However, a spiral spring clutch may be fixed to the rotating shaft as the reverse rotation preventing unit so that the rotation of the spiral spring in a tightening direction is transmitted to the support roller and the rotation of the spiral spring in a loosening direction is not transmitted to the support roller.

The present application contains subject matter related to that disclosed in Japanese Priority Patent Application JP 2009-0:30534 filed in the Japan Patent Office on Feb. 12, 2009, the entire contents of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A liquid discharge apparatus comprising:

a plurality of nozzles that discharge liquid;

a liquid discharge head that includes nozzle arrays where the respective nozzles are arranged in one direction;

a liquid adsorbent that adsorbs liquid attached to a portion of the liquid discharge head where the nozzle arrays are formed;

a moving means for relatively moving the liquid adsorbent in an arrangement direction of the nozzles;

support rollers that support the liquid adsorbent so as to allow the liquid adsorbent to rotate;

a rotating shaft that corresponds to the axis of rotation of the support rollers and is rotated in a normal or reverse direction by using the relative movement of the liquid adsorbent, which is caused by the moving means, as a source of power;

a reverse rotation preventing means for transmitting the normal rotation of the rotating shaft to the support roller and not transmitting the reverse rotation of the rotating shaft to the support roller;

a slide part that is moved in an arrangement direction of the nozzles by the moving means;

a swing part that is mounted on the slide part, holds the rotating shaft, and is lifted or lowered with respect to the slide part; and a guide portion that allows the swing part to be lifted or lowered as the slide part is moved, and guides the rotating shaft so that the rotating shaft is rotated in a normal or reverse direction.

2. The liquid discharge apparatus according to claim 1, wherein the swing part is mounted on the slide part by a link mechanism, and the rotating shaft is a component of a lower journal portion, which is disposed at the swing part, of the link mechanism.

3. The liquid discharge apparatus according to claim 2, wherein the link mechanism is a four-node link mechanism.

4. The liquid discharge apparatus according to claim 1, wherein the plurality of nozzles is provided in parallel in the liquid discharge head, and the liquid adsorbent is formed to have a width larger than a distance between both outer nozzle arrays that are disposed in parallel.

5. The liquid discharge apparatus according to claim 1, wherein the liquid discharge head is a line head where the nozzles are arranged along the width of an object to which liquid is discharged.

6. The liquid discharge apparatus according to claim 1, wherein the liquid adsorbent is an endless cleaning belt that is installed so as to be rotated by the support rollers, and the cleaning belt is disposed so that an angle is formed between the width direction of the cleaning belt and the arrangement direction of the nozzles and the cleaning belt positioned on the peripheral surface of the support roller comes into contact with the portion of the liquid discharge head where the nozzle arrays are formed.

7. The liquid discharge apparatus according to claim 1, wherein the reverse rotation preventing means is a one-way mechanism that is provided between the support roller and the rotating shaft so as to transmit the normal rotation of the rotating shaft to the support roller and so as not to transmit the reverse rotation of the rotating shaft to the support roller.

8. The liquid discharge apparatus according to claim 7, wherein the one-way mechanism is a one-way clutch.

9. A liquid discharge apparatus comprising:

a plurality of nozzles that discharges liquid;

a liquid discharge head that includes nozzle arrays where the respective nozzles are arranged in one direction;

a liquid adsorbent that adsorbs liquid attached to a portion of the liquid discharge head where the nozzle arrays are formed;

a moving unit configured to relatively move the liquid adsorbent in an arrangement direction of the nozzles;

support rollers that support the liquid adsorbent so as to allow the liquid adsorbent to rotate;

a rotating shaft that corresponds to the axis of rotation of the support rollers and is rotated in a normal or reverse direction by using the relative movement of the liquid adsorbent, which is caused by the moving unit, as a source of power;

a reverse rotation preventing unit configured to transmit the normal rotation of the rotating shaft to the support roller and not transmitting the reverse rotation of the rotating shaft to the support roller;

a slide part that is moved in an arrangement direction of the nozzles by the moving unit;

a swing part that is mounted on the slide part, holds the rotating shaft, and is lifted or lowered with respect to the slide part; and a guide portion that allows the swing part to be lifted or lowered as the slide part is moved, and guides the rotating shaft so that the rotating shaft is rotated in a normal or reverse direction.

* * * * *

UNITED STATES PATENT AND TRADEMARK OFFICE

CERTIFICATE OF CORRECTION

PATENT NO. : 8,256,873 B2
APPLICATION NO. : 12/693738
DATED : September 4, 2012
INVENTOR(S) : Shunji Yamaguchi et al.

It is certified that error appears in the above-identified patent and that said Letters Patent is hereby corrected as shown below:

On the title page, Item (30), the Foreign Application Priority Data is omitted. Item (30) should read:

--(30) Foreign Application Priority Data

Feb. 12, 2009 (JP).....2009-030534--

Signed and Sealed this
Eighteenth Day of December, 2012

David J. Kappos

David J. Kappos
*Director of the United States Patent and Trademark Office*